US011804158B2

(12) United States Patent
Hosaka

(10) Patent No.: US 11,804,158 B2
(45) Date of Patent: Oct. 31, 2023

(54) PROJECTION-TYPE DISPLAY DEVICE, AND CONTROL METHOD FOR PROJECTION-TYPE DISPLAY DEVICE

(71) Applicant: SEIKO EPSON CORPORATION, Tokyo (JP)

(72) Inventor: Hiroyuki Hosaka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/824,544

(22) Filed: May 25, 2022

(65) Prior Publication Data

US 2022/0383785 A1 Dec. 1, 2022

(30) Foreign Application Priority Data

May 26, 2021 (JP) ..... 2021-088219

(51) Int. Cl.
*G09G 3/00* (2006.01)
*G09G 3/36* (2006.01)

(52) U.S. Cl.
CPC ..... *G09G 3/007* (2013.01); *G09G 3/3614* (2013.01); *G09G 2310/08* (2013.01); *G09G 2320/0247* (2013.01)

(58) Field of Classification Search
CPC .. G09G 3/007; G09G 3/3614; G09G 2310/08; G09G 2320/0247
See application file for complete search history.

(56) References Cited

U.S. PATENT DOCUMENTS

2015/0219983 A1* 8/2015 Mashitani ..... H04N 9/3188 353/121
2020/0098295 A1* 3/2020 Hosaka ..... G09G 3/2022

FOREIGN PATENT DOCUMENTS

JP 2020-052132 A 4/2020

* cited by examiner

*Primary Examiner* — David Tung
(74) *Attorney, Agent, or Firm* — Oliff PLC

(57) ABSTRACT

In a projection-type display device including a liquid crystal panel where panel pixels are arranged in a first direction and a second direction, the polarity of the image signal supplied to each of all panel pixels is set to the same polarity in the same unit period among a plurality of unit periods, and the polarity of the image signal is reversed upon transition from the current frame period to the next frame period. The polarity of the image signal is reversed when a projection pixel is shifted by a light path shifting element unit in the first direction or in the second direction upon transition of the unit period, and the polarity of the image signal is not reversed when it is shifted along a third direction or a fourth direction that intersects the first direction and the second direction.

12 Claims, 15 Drawing Sheets

PROJECTION-TYPE DISPLAY DEVICE, AND CONTROL METHOD FOR PROJECTION-TYPE DISPLAY DEVICE

The present application is based on, and claims priority from JP Application Serial Number 2021-088219, filed May 26, 2021, the disclosure of which is hereby incorporated by reference herein in its entirety.

BACKGROUND

1. Technical Field

The present disclosure relates to a projection-type display device, and a control method for a projection-type display device.

2. Related Art

In liquid crystal panels used for projection-type display devices, a plurality of pixels provided with a liquid crystal layer between a pixel electrode and a common electrode are disposed in a first direction and a second direction that intersect each other. The resolution of a liquid crystal panel is defined by the pitch of adjacent pixels, but the reduction of the pitch of pixels is limited. In view of this, for the purpose of increasing the resolution of the projection image, a technique in which the position where the projection pixel is visually recognized is shifted for each predetermined period by using a light path shifting element is proposed (see, for example, JP-A-2020-52132).

On the other hand, since application of a DC component to a liquid crystal layer in a liquid crystal panel tends to cause degradation, a polarity inversion drive that alternately switches the voltage applied to the pixel electrode between a positive polarity on the high side and a negative polarity on the low side relative to the potential of the common electrode is often performed. For example, JP-A-2020-52132 proposes to reverse the polarity for each frame, each unit period, or each subfield.

If all pixels are set to the same polarity in the same period in a liquid crystal panel, flicker tends to be visually recognized, and it is therefore preferable to employ dot reverse driving in which the polarity differs between adjacent pixels. However, in the case where the resolution is increased by shifting the projection pixel by using a light path shifting element as in the technique disclosed in JP-A-2020-52132, there are periods in which the polarity is the same between adjacent pixels in the first direction and between adjacent pixels in the second direction in the projected image even when the dot reverse driving is performed in the liquid crystal panel. Therefore, in the case of the projection-type display device that shifts the projection pixel by using the light path shifting element, it is difficult for the known technology to reverse the polarity of adjacent projection pixels in the projection image, and flicker tends to be visually recognized.

SUMMARY

To solve the above-mentioned problems, a projection-type display device according to an aspect of the present disclosure includes a liquid crystal panel including a plurality of panel pixels including a liquid crystal layer between a pixel electrode and a common electrode is arranged in a first direction and a second direction that intersects the first direction, a light path shifting element configured to generate a projection image by shifting, for each of a plurality of unit periods included in one frame period, a position of a projection pixel where light projected from the panel pixel is visually recognized, and a control unit configured to control a timing when the light path shifting element shifts the projection pixel, a direction in which the light path shifting element shifts the projection pixel, and an image signal supplied to each of the plurality of panel pixels. The control unit sets a polarity of the image signal to a same polarity in a same unit period among the plurality of unit periods, reverses the polarity of the image signal upon transition from a current frame period to a next frame period, and reverses the polarity of the image signal when the light path shifting element shifts the projection pixel along at least one of a direction parallel to a first direction and a direction parallel to a second direction that intersects the first direction upon transition from a current unit period to a next unit period.

A control method according to another aspect of the present disclosure is a method for a projection-type display device, the projection-type display device including a liquid crystal panel including a plurality of panel pixels including a liquid crystal layer between a pixel electrode and a common electrode is arranged in a first direction and a second direction that intersects the first direction, the projection-type display device being configured to generate a projection image by shifting, for each of a plurality of unit periods included in one frame period, a position of a projection pixel where light projected from the panel pixel is visually recognized. A polarity of the image signal supplied to each of the plurality of panel pixels is set to a same polarity in a same unit period among the plurality of unit periods, the polarity of the image signal is reversed upon transition from a current frame period to a next frame period, and the polarity of the image signal is reversed when the projection pixel is shifted along at least one of a direction parallel to a first direction and a direction parallel to a second direction that intersects the first direction upon transition from a current unit period to a next unit period.

A control method according to another aspect of the present disclosure is a method for a projection-type display device, the projection-type display device including a liquid crystal panel including a liquid crystal layer sandwiched between a pixel electrode and a common electrode. A projection image is generated by shifting, for each of a plurality of unit periods included in one frame period, light projected from the liquid crystal panel, the frame period includes a first unit period, a second unit period, a third unit period and a fourth unit period, an image signal of a positive polarity is supplied to the pixel electrode in the first unit period and the second unit period, and an image signal of a negative polarity is supplied to the pixel electrode in the third unit period and the fourth unit period.

DESCRIPTION OF EXEMPLARY EMBODIMENTS

An embodiment of the present disclosure is described below with reference to the accompanying drawings. Of two directions intersecting each other in the in-plane direction of a liquid crystal panel 10, the first direction is denoted with X and the second direction that intersects the first direction X is denoted with Y in the following description. In addition, the direction that intersects both of the first direction X and the second direction Y is a third direction C, and the direction that obliquely intersects the first direction X and the second direction Y on the side opposite to the third direction C is a fourth direction D in the following description. In addition, one of the directions extending parallel to the first direction X is denoted with X1, the other of the directions extending parallel to the first direction X is denoted with X2, one of the directions extending parallel to the second direction Y is denoted with Y1, and the other of the directions extending parallel to the second direction Y is denoted with Y2 in the following description.

In the present disclosure, one frame period is a period required for a light path shifting element 110 to perform one cycle of repetition of the operation of shifting a projection pixel Pi in a predetermined order. Accordingly, in a first exemplary operation and a second exemplary operation described later, one frame period corresponds to a period required for displaying one frame of an image. On the other hand, in the case where one frame period includes a first subframe period and a second subframe period as in a third exemplary operation described later, the light path shifting element 110 performs the repetition of the operation of shifting the projection pixel Pi in a predetermined order for one cycle during one frame period, while one frame of an image is displayed in each of the first subframe period and the second subframe period.

In addition, the embodiment described below is a specific preferable example of the present disclosure, and therefore has various technically favorable limitations. However, the technical scope of the present disclosure is not limited to these embodiments unless otherwise stated in the following description to limit the present disclosure. For example, the combination of directions in which the light path shifting element 110 shifts the projection pixel Pi, the order of the directions in which the light path shifting element 110 shifts the projection pixel Pi, and the like are not limited to the modes exemplified in the first exemplary operation, the second exemplary operation, and the third exemplary operation described below.

1. Exemplary Configuration of Projection-Type Display Device 1

Figure 1:
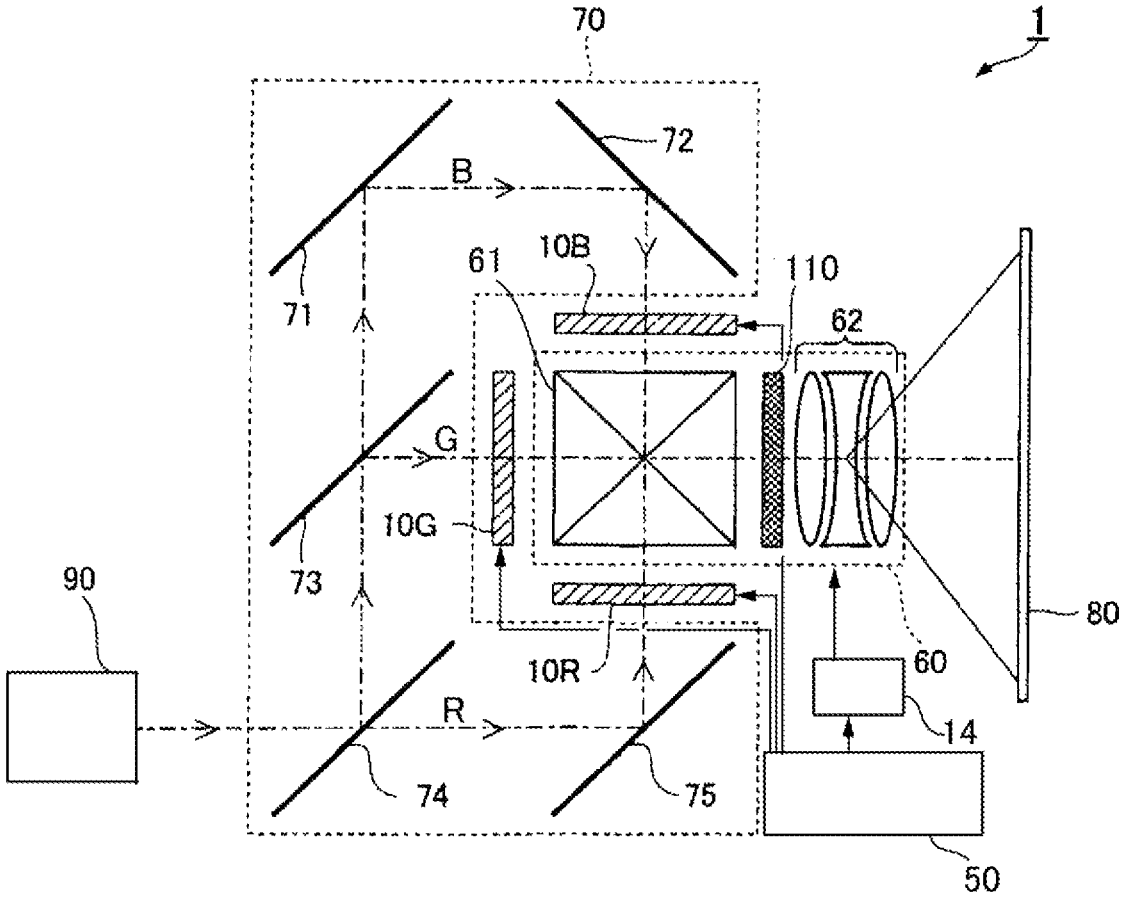
FIG. 1 is a block diagram illustrating an exemplary configuration of a projection-type display device to which the present disclosure is applied.
Figure 2:
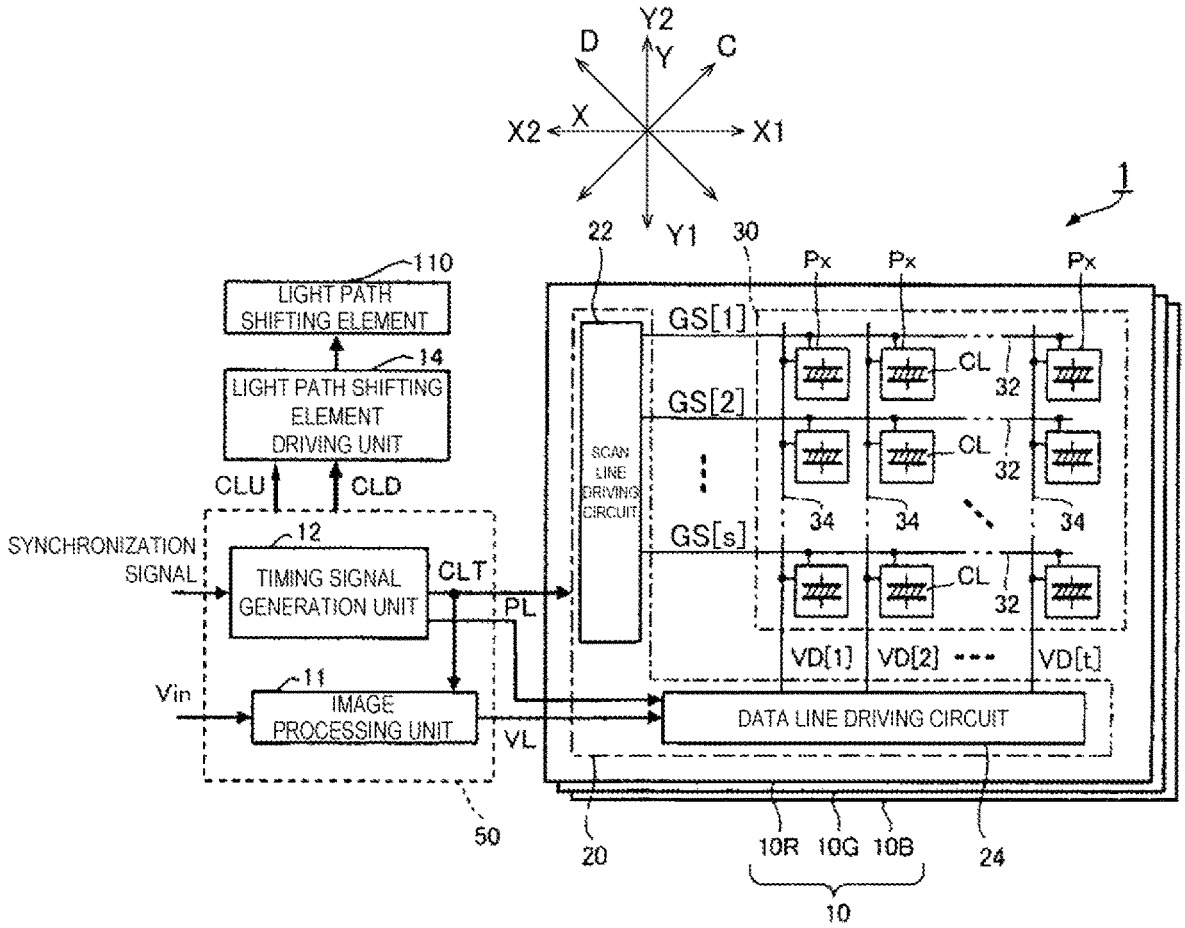
FIG. 2 is a block diagram illustrating an exemplary configuration of a control system and the like of the projection-type display device illustrated in FIG. 1.
Figure 3:
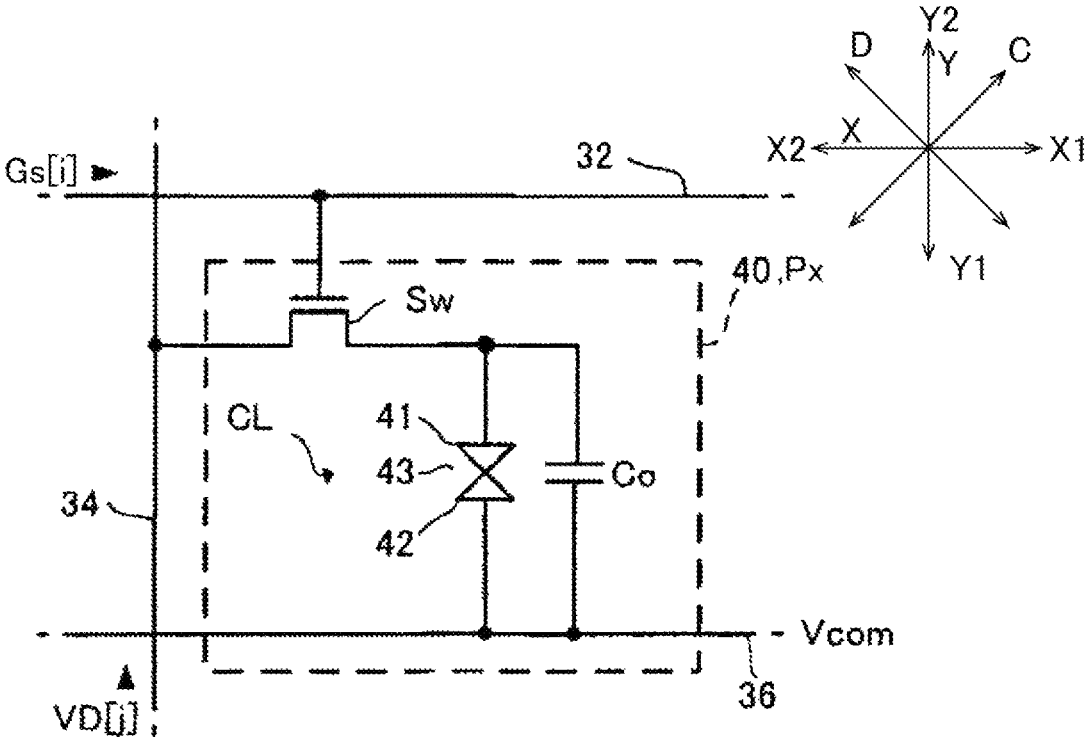
FIG. 3 is a circuit diagram of a pixel circuit corresponding to a panel pixel illustrated in FIG. 2.

FIG. 1 is a block diagram illustrating an exemplary configuration of a projection-type display device 1 to which the present disclosure is applied. FIG. 2 is a block diagram illustrating an exemplary configuration of a control system and the like of the projection-type display device 1 illustrated in FIG. 1. FIG. 3 is a circuit diagram of a pixel circuit 40 corresponding to a panel pixel Px illustrated in FIG. 2. Note that in FIG. 1, the illustration of the polarization plate and the like is omitted. The projection-type display device 1 illustrated in FIG. 1 includes an illumination device 90, a separation optical system 70, three liquid crystal panels 10R, 10G and 10B, and a projection optical system 60. In the liquid crystal panels 10R, 10G and 10B, a liquid crystal layer is disposed between a pair of substrates, and the liquid crystal layer is driven between a pixel electrode formed in one substrate of the pair of substrates and a common electrode formed in the other substrate.

The illumination device 90 is a white light source, and a laser light source or a halogen lamp is used for it, for example. The separation optical system 70 includes three mirrors 71, 72 and 75, and dichroic mirrors 73 and 74. The separation optical system 70 separates white light emitted from the illumination device 90 into three primary colors, namely, red R, green G and blue B. More specifically, the dichroic mirror 74 transmits light of the wavelength range of red R, and reflects light of the wavelength ranges of green G and blue B. The dichroic mirror 73 transmits light of the wavelength range of blue B, and reflects light of the wavelength range of green G.

Light corresponding to red R, green G, and blue B is guided to the liquid crystal panels 10R, 10G and 10B, respectively. The liquid crystal panels 10R, 10G and 10B are used as a spatial light modulator. In the following description, the liquid crystal panels 10R, 10G and 10B may be collectively referred to as the liquid crystal panel 10.

Light modulated by the liquid crystal panels 10R, 10G and 10B impinges on a dichroic prism 61 from three directions. The dichroic prism 61 makes up a composite optical system that combines images of red R, green G, and blue B.

On the side from which light is emitted in the dichroic prism 61, the projection optical system 60 includes a projection lens system 62 and the light path shifting element 110. The light path shifting element 110 is an optical element that shifts light emitted from the dichroic prism 61, in a predetermined direction. The projection lens system 62 projects a composite image emitted from the light path shifting element 110, on a projection target member such as a screen 80 in an enlarged manner. As a result, a color image is displayed on the projection target member such as the screen 80.

As illustrated in FIG. 2, the projection-type display device 1 includes three liquid crystal panels 10 composed of the liquid crystal panels 10R, 10G and 10B, a control unit 50, a light path shifting element driving unit 14, and the light path shifting element 110. The control unit 50 and the light path shifting element driving unit 14 are composed of an electric circuit, while they may be implemented as a module executed by a CPU. The liquid crystal panel 10 includes a display unit 30 where the plurality of the panel pixels Px are arranged, and a driving circuit 20 that drives the plurality of the panel pixels Px.

In the display unit 30 of the liquid crystal panel 10, s scan lines 32 extending in the first direction X, and t data lines 34 extending in the second direction Y are formed. Each of s and t is a positive integer of two or greater. In the display unit 30, a plurality of the panel pixels Px are arranged in vertical s rows×horizontal t columns in a manner corresponding to the intersections of the scan line 32 and the data line 34. In this embodiment, the panel pixels Px are disposed at all s×t intersections of the s scan lines 32 and the t data lines 34. It should be noted that the panel pixels Px may be disposed at some of s×t intersections.

In FIGS. 2 and 3, the driving circuit 20 includes a scan line driving circuit 22 and a data line driving circuit 24, and supplies an image signal VD[j] that designates the display gradation level of each of the plurality of the panel pixels Px to the pixel circuit 40 of each of the plurality of the panel pixels Px. The j is an integer that satisfies $1 \leq j \leq t$. The scan line driving circuit 22 supplies a scanning signal GS[i] to the scan line 32 of the ith row. The scan line driving circuit 22 selects the scan line 32 of the ith row by setting the scanning signal GS[i] to a predetermined selection potential. The i is an integer that satisfies $1 \leq i \leq s$. The data line driving circuit 24 supplies image signals VD[1] to VD[t] to the data line 34 of the first row to tth row in synchronization with the selection of the scan line 32 at the scan line driving circuit 22. In other words, the data line driving circuit 24 supplies the image signal VD[j] to the data line of the jth row.

The pixel circuit 40 includes a liquid crystal element CL, a selection switch Sw, and a capacity Co. The liquid crystal element CL is an electrooptic element including a pixel electrode 41, a common electrode 42, and the liquid crystal layer 43 provided between the pixel electrode 41 and the common electrode 42. In the liquid crystal element CL, when a voltage is applied between the pixel electrode 41 and the common electrode 42, the relative transmittance of the liquid crystal element CL changes in accordance with the value of the applied voltage. Then, the panel pixel Px displays a gradation level corresponding to the relative transmittance of the liquid crystal element CL.

The relative transmittance of the liquid crystal element CL is a relative value representing the quantity of light transmitted through the liquid crystal element CL. In this embodiment, the quantity of light that is transmitted through the liquid crystal element CL in the state where no voltage is applied to the liquid crystal element CL and the liquid crystal layer 43 is least permeable to light is 0%. In addition, the quantity of light that is transmitted through the liquid crystal element CL in the state where the maximum voltage that can be applied to the liquid crystal element CL is applied and the liquid crystal layer 43 is most permeable to light is 100%.

This embodiment describes an exemplary case where the liquid crystal layer 43 provided in the liquid crystal element CL is of a vertical alignment (VA) type, and the mode is a normally black mode in which the panel pixel Px is black display in the state where no voltage is applied between the pixel electrode 41 and the common electrode 42. The black display means that the relative transmittance of the liquid crystal element CL is 0%.

The common electrode 42 is set to a predetermined reference potential. The capacity Co is electrically connected to a capacitance line 36 whose one end is electrically connected to the pixel electrode 41 and the other end is kept at a constant voltage Vcom. In addition, the common electrode 42 is also held at the voltage Vcom. The selection switch Sw is, for example, an n-channel transistor. The selection switch Sw is provided between the pixel electrode 41 and the data line 34, and controls their electrical connection states, namely, conduction and insulation. More specifically, the gate of the selection switch Sw, which is an n-channel transistor, is electrically connected to the scan line 32. When the scanning signal GS[i] is set to a selection potential, the selection switch Sw provided at the pixel circuit 40 of ith row is set to an on state. The image signal VD[j] is supplied from the data line 34 to the pixel circuit 40 where the selection switch Sw is set to an on state, and a voltage corresponding to the image signal VD[j] is applied to the liquid crystal element CL. In this manner, the transmittance of the liquid crystal element CL of the pixel circuit 40 is changed in accordance with the image signal VD[j], and the panel pixel Px corresponding to this pixel circuit 40 displays a gradation level corresponding to the image signal VD[j].

When the selection switch Sw is set to an off state after a voltage corresponding to the image signal VD[j] is applied to the liquid crystal element CL of the pixel circuit 40, the potential at the pixel electrode 41 is held by the capacity Co. Therefore, in a period until the selection switch Sw is set to an on state after the selection switch Sw is set to an on state, a voltage corresponding to the image signal VD[j] is continuously applied to the liquid crystal element CL. Here, when a DC voltage is applied to the liquid crystal element CL, its electrical characteristics are degraded and a so-called burn-in phenomenon is caused. In view of this, this embodiment employs an AC drive that reverses the potential of the image signal VD[j] relative to a predetermined potential. The predetermined potential is, for example, a common potential applied to the common electrode 42. A potential with the voltage drop of the transistor of the selection switch Sw taken into account may be employed as the predetermined potential. The case where the potential of the image signal VD[j] is higher than the predetermined potential is referred to as positive polarity (+), and the case where the potential of the image signal VD[n] is lower than the predetermined potential is referred to as negative polarity (−). For the reverse of the polarity, this embodiment employs a method in which the polarity of the image signal VD[j] applied to the pixel electrode 41 with respect to the predetermined potential is changed, with the predetermined potential fixed.

With reference to FIG. 2 again, the control unit 50 includes an image processing unit 11 and a timing signal generation unit 12. The timing signal generation unit 12 generates a control signal CLT for controlling the driving circuit 20 and the image processing unit 11 on the basis of a synchronization signal supplied from a higher-level device (not illustrated), and supplies the generated control signal CLT to the driving circuit 20 and the image processing unit 11. The timing signal generation unit 12 generates a polarity signal PL that defines the polarity of the image signal VD[n], and supplies it to the data line driving circuit 24. The data line driving circuit 24 sets the polarity of the image signal VD[n] in accordance with the polarity signal PL. The timing signal generation unit 12 generates a control signal CLD for controlling the light path shifting element 110 on the basis of the synchronization signal. When an input video signal Vin representing an image that should be displayed by the projection-type display device 1 is supplied from a higher-level device, the image processing unit 11 generates an output image signal VL representing the gradation level of the panel pixel Px in a plurality of unit periods described later on the basis of the input video signal Vin and the control signal CLT. In addition, the image processing unit 11 generates a control signal CLU that designates the shift direction of the light path shifting element 110 and the like on the basis of the input video signal Vin, and supplies it to the light path shifting element driving unit 14.

The light path shifting element driving unit 14 drives the light path shifting element 110 on the basis of the control signal CLD supplied from the timing signal generation unit 12 and the control signal CLU supplied from the image processing unit 11. Accordingly, the control unit 50 controls the timing when the light path shifting element 110 shifts the projection pixel Pi, the direction in which the light path shifting element 110 shifts the projection pixel Pi, and the image signal VD[j] supplied to each of the plurality of the panel pixels Px.

2. Exemplary Configuration of Light Path Shifting Element, and Resolution

Figure 4:
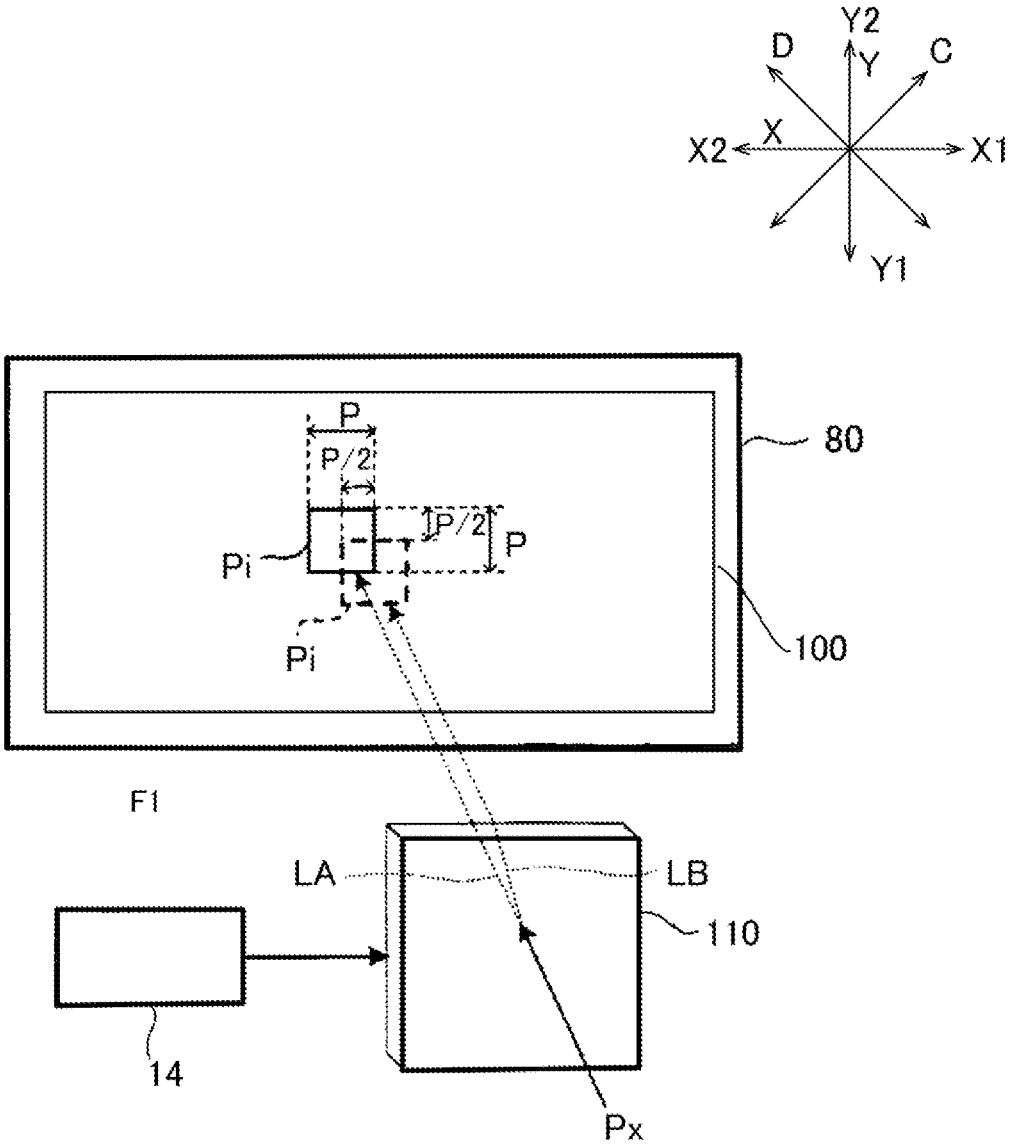
FIG. 4 is a diagram for describing a light path shifting element illustrated in FIG. 2.

FIG. 4 is a diagram for describing the light path shifting element 110 illustrated in FIG. 2. FIG. 4 illustrates an exemplary state where the position of the projection pixel Pi where light emitted from the panel pixel Px is visually recognized is shifted by the light path shifting element 110 along the direction parallel to the fourth direction D, by a distance corresponding to 0.5 pixel pitch (=P/2) to one side X1 in the first direction X and 0.5 pixel pitch (=P/2) to the one side Y1 in the second direction Y. FIG. 4 illustrates an exemplary case where the light path shifting element 110 includes a translucent plate, and the projection pixel Pi is shifted by swaying the translucent plate around one or both of the axis line extending in the first direction and the axis line extending in the second direction.

Figure 5:
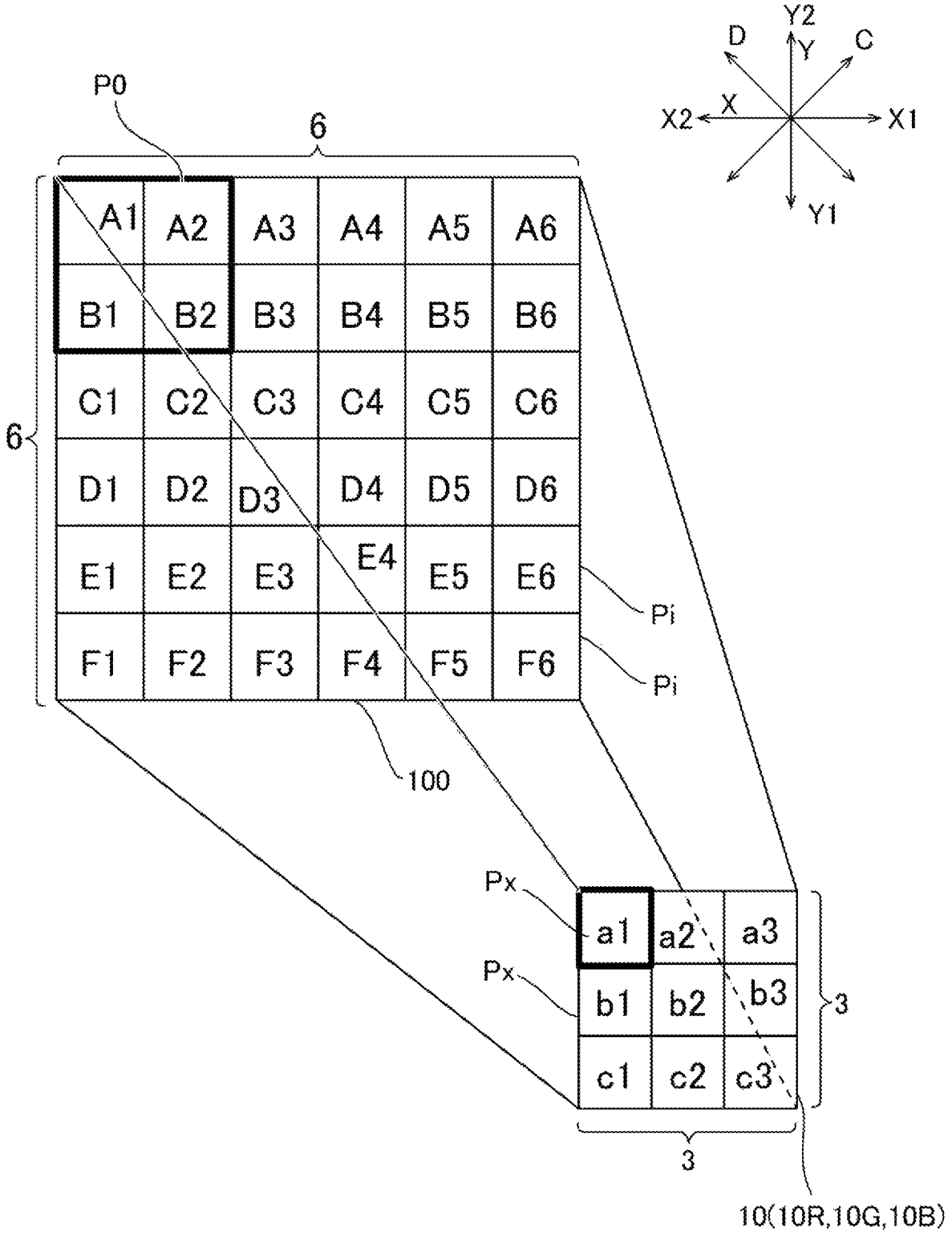
FIG. 5 is a diagram for describing an effect for a display resolution through a shift of a projection pixel.

FIG. 5 is a diagram for describing an effect of a shift of the projection pixel Pi for the display resolution. FIG. 5 illustrates only some of a plurality of the projection pixels Pi in a projection image 100. In addition, FIG. 5 illustrates only some of a plurality of the panel pixels Px of the liquid crystal panel 10. Note that in the projection image 100 in FIG. 5, the first row is indicated as A1, A2, . . . , the second row as B1, B2, . . . , and the third row as C1, C2, . . . , for the sake of discriminating the projection pixel Pi. In addition, in the liquid crystal panel 10 of FIG. 5, the first row is indicated as a1, a2, . . . , the second row as b1, b2, . . . , and the third row as c1, c2, . . . , for the sake of discriminating the panel pixel Px.

The light path shifting element 110 illustrated in FIG. 4 generates the projection image 100 by shifting the projection pixel Pi where light emitted from each of the plurality of the panel pixels Px of the liquid crystal panel 10 is visually recognized in the direction controlled by the control signal CLU among the first direction X, the second direction Y, the third direction C, and the fourth direction D for each unit period described later as dotted lines LA and LB indicating the light paths before and after the shift. In this embodiment, the light path shifting element 110 is a distance corresponding to ½ of the pixel pitch P in the direction parallel to the first direction X and the direction parallel to the second direction Y regardless of whether the shift direction is the first direction X, the second direction Y, the third direction C, or the fourth direction D.

Accordingly, as illustrated in FIG. 5, when, for example, the projection pixel Pi projected from the panel pixel Px represented by a reference numeral a1 in the liquid crystal panel 10 is shifted to one side X1 along the direction parallel to the first direction X in the first unit period, to one side Y1 along the direction parallel to the second direction Y in the second unit period, to the other side X2 along the direction parallel to the first direction X in the third unit period, and to the other side Y2 along the direction parallel to the second direction Y in the fourth unit period, the projection pixel Pi projected from one panel pixel a1 is visually recognized at four locations surrounded by a thick line P0. In the meantime, the gradation of the panel pixel Px is controlled for each unit period. Therefore, when the resolution indicated by the arrangement of the projection pixel Pi in the projection image 100 is referred to as display resolution and the resolution indicated by the arrangement of the panel pixel Px in the liquid crystal panel 10 is referred to as panel resolution, the display resolution is twice in the first direction X and twice in the second direction Y with respect to the panel resolution.

3. First Exemplary Operation

Figure 6:
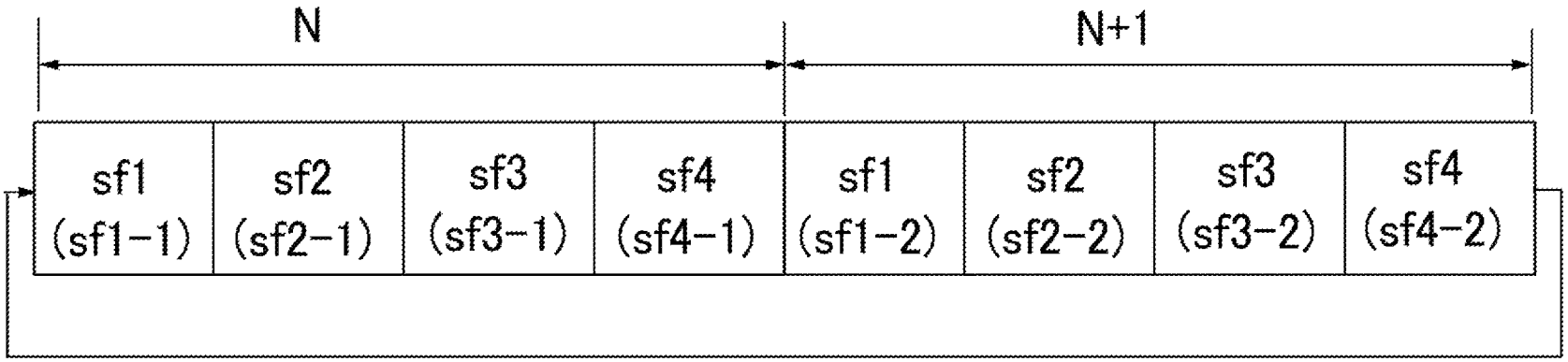
FIG. 6 is a diagram for describing a unit period in a first exemplary operation of the projection-type display device illustrated in FIG. 1.
Figure 7:
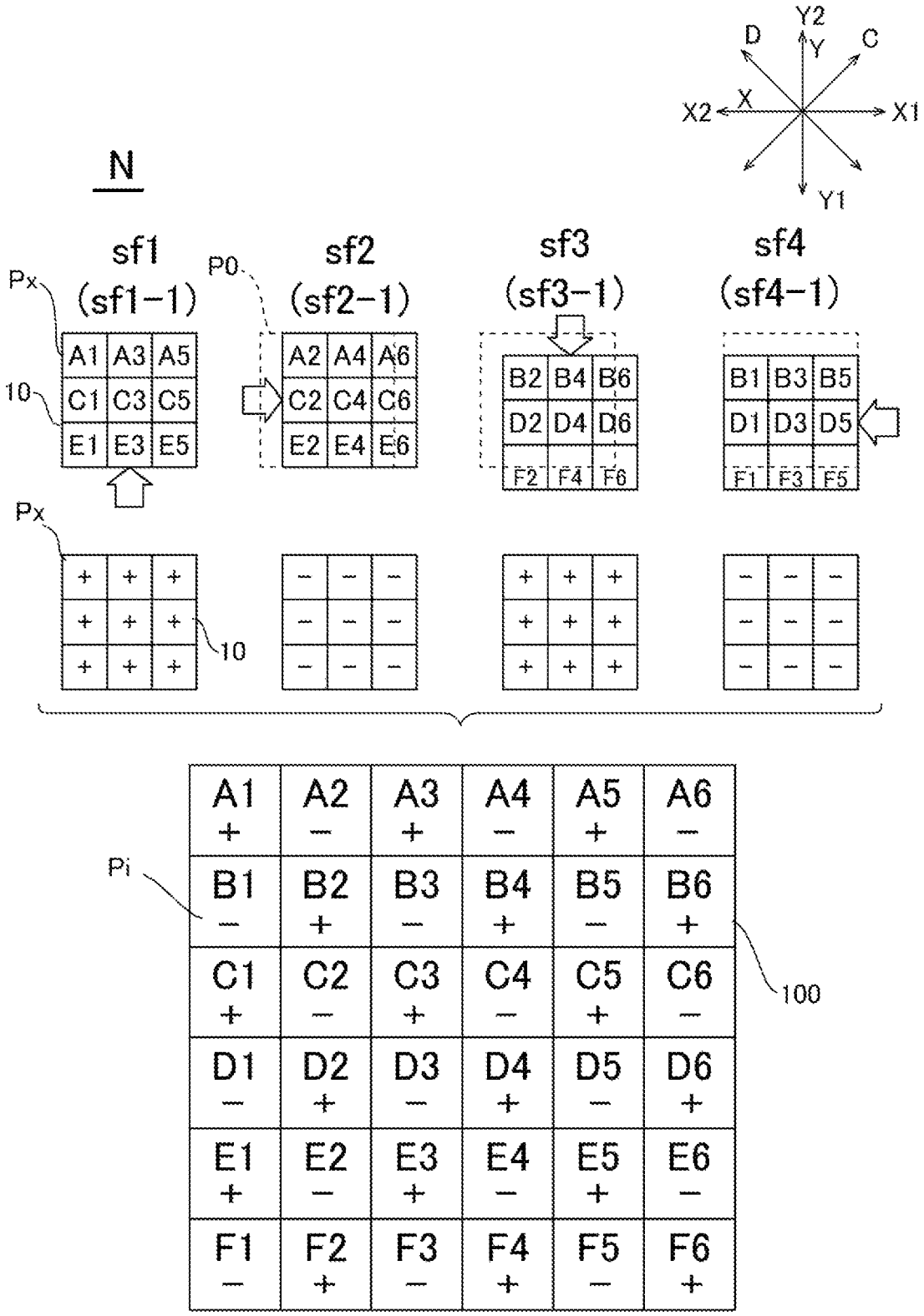
FIG. 7 is a diagram for describing a current frame period in the first exemplary operation of the projection-type display device illustrated in FIG. 1.
Figure 8:
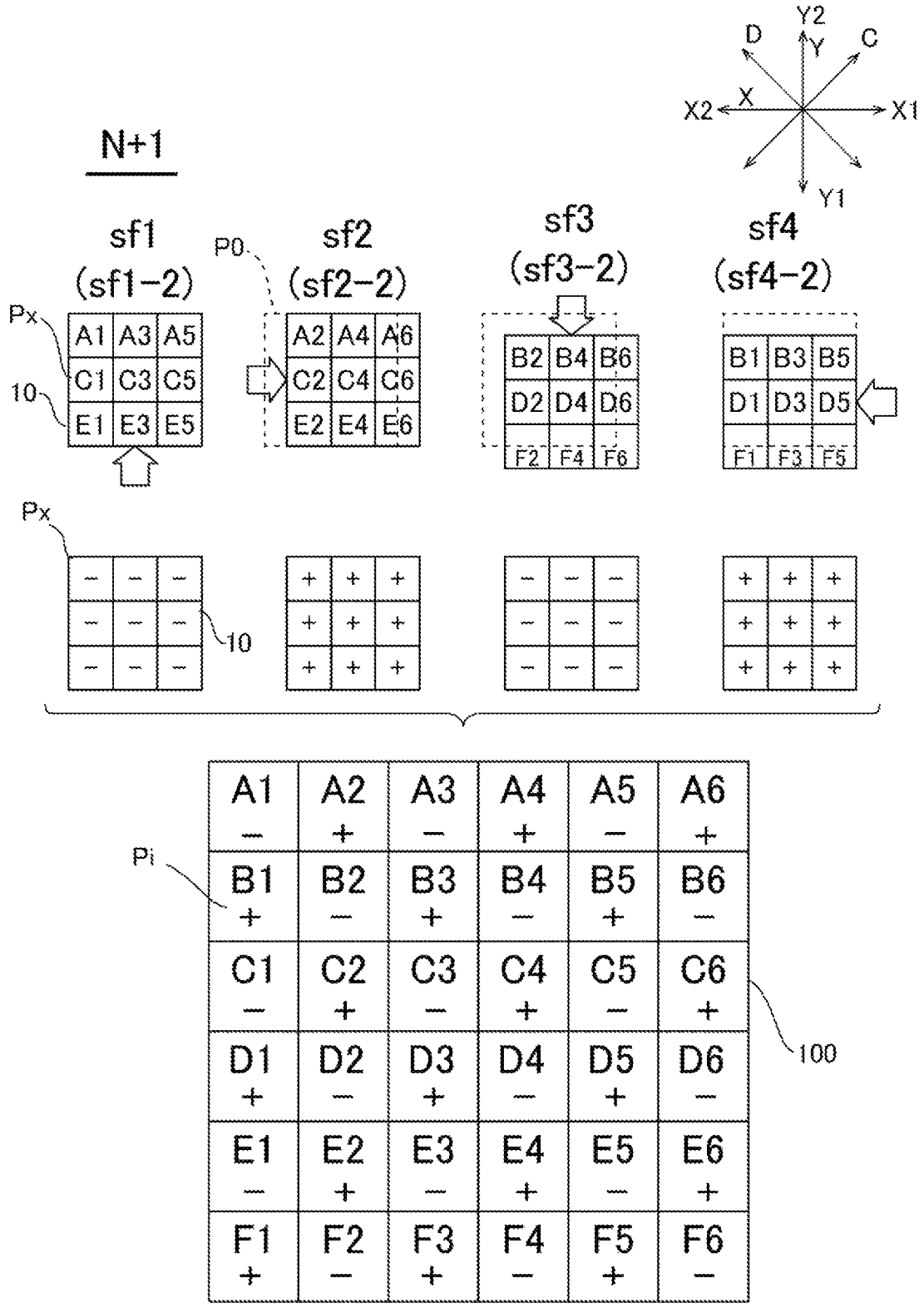
FIG. 8 is a diagram for describing a next frame period in the first exemplary operation of the projection-type display device illustrated in FIG. 1.

FIG. 6 is a diagram for describing a unit period in a first exemplary operation of the projection-type display device 1 illustrated in FIG. 1. FIG. 7 is a diagram for describing a current frame period N in the first exemplary operation of the projection-type display device 1 illustrated in FIG. 1. FIG. 8 is a diagram for describing a next frame period N+1 in the first exemplary operation of the projection-type display device 1 illustrated in FIG. 1. In FIGS. 7 and 8, the upper section illustrates the shift direction of the light path shifting element 110, the projection pixel P expressed by the plurality of the panel pixels Px, and the polarities of the plurality of the panel pixels Px, and the lower section illustrates the polarities of the panel pixels Px when the plurality of the projection pixels Pi of the projection image 100 are expressed. Note that in the upper section of FIGS. 7 and 8, the dotted line indicates the positions of nine panel pixels Px of the first unit period sf1−1.

FIG. 6 illustrates odd-numbered frame periods in a plurality of frame periods as frame period N, and even-numbered frame periods as frame period N+1. In this manner, after the current frame period N is executed, the next frame period N+1 is executed. In addition, after the frame period N+1 is completed, the frame period N is executed. The frame period N and the frame period N+1 have the same length.

Each of the frame period N and the frame period N+1 is divided into four unit periods sf, namely, a first unit period sf1, a second unit period sf2, a third unit period sf3, and a fourth unit period sf4. The four unit periods sf have the same length. In FIGS. 6, 7, and 8, the four unit periods sf in the frame period N and the four unit periods sf in the frame period N+1 are discriminated as follows for the sake of convenience.

Current frame period N
First unit period sf1−1
Second unit period sf2−1
Third unit period sf3−1

Fourth unit period sf4−1
Next frame period N+1
First unit period sf1−2
Second unit period sf2−2
Third unit period sf3−2
Fourth unit period sf4−2

As illustrated in FIG. 7, in the frame period N, the four projection pixels A1, A2, B1 and B2 of the projection image 100 are expressed by the panel pixel a1 of the liquid crystal panel 10. In addition, as illustrated in FIG. 8, also in the frame period N+1, the four projection pixels A1, A2, B1 and B2 are expressed by the panel pixel a1 of the liquid crystal panel 10. Other pixels are also expressed in the same manner. For example, in the frame periods N and N+1, four projection pixels A3, A4, B3 and B4 are expressed by the panel pixel a2 of the liquid crystal panel 10.

As illustrated in FIGS. 7 and 8, in the frame period N and the frame period N+1, the light path shifting element 110 shifts the projection pixel Pi by 0.5 pixel pitch for each unit period sf. At this time, the control unit 50 sets the same polarity to the image signal VD supplied to the pixel electrode 41 of each of all of the plurality of panel pixels Px in the same unit period sf in the plurality of unit periods sf, and the control unit 50 reverses the polarity of the image signal VD supplied to the pixel electrode 41 of each of all of the plurality of panel pixels Px when the light path shifting element 110 shifts the projection image along at least one of the direction parallel to the first direction X and the direction parallel to the second direction Y upon transition from the current unit period sf to the next unit period sf in the same frame period N. In addition, the control unit 50 reverses the polarity of the image signal VD supplied to the pixel electrode 41 of each of all of the plurality of panel pixels Px between the current frame period N and the next frame period N+1.

In this embodiment, the shift direction of the light path shifting element 110 is two directions, namely, the first direction X and the second direction Y.

More specifically, as illustrated in FIG. 7, in the first unit period sf1−1 of the frame period N, the control unit 50 sets the polarity of the image signal VD for all of the plurality of panel pixels Px to +.

Next, upon transition from the first unit period sf1−1 to the second unit period sf2−1, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from + to −.

Next, upon transition from the second unit period sf2−1 to the third unit period sf3−1, the light path shifting element 110 shifts the projection pixel Pi toward the one side Y1 in the second direction Y by 0.5 pixel pitch along the direction parallel to the second direction Y. At this time, the control unit 50 reverses the polarity of the image signal VD for all of the plurality of panel pixels Px from − to +.

Next, upon transition from the third unit period sf3−1 to the fourth unit period sf4−1, the light path shifting element 110 shifts the projection pixel Pi by 0.5 pixel toward the other side X2 in the first direction X along the direction parallel to the first direction X. At this time, the control unit 50 reverses the polarity of the image signal VD for all of the plurality of panel pixels Px from + to −. In this manner, the frame period N is terminated.

Next, as illustrated in FIG. 8, upon transition from the fourth unit period sf4−1 of the current frame period N to the first unit period sf1−2 of the next frame period N+1, the light path shifting element 110 shifts the projection pixel Pi toward the other side Y2 in the second direction Y along the direction parallel to the second direction Y. In transition from the current frame period N to the next frame period N+1 in this manner, the control unit 50 reverses the polarity of the image signal VD supplied to the pixel electrode 41 of each of all of the plurality of panel pixels Px between the current frame period N and the next frame period N+1. In this embodiment, in the first unit period sf1−1 of the frame period N, the polarity of the image signal VD is +, and therefore the control unit 50 sets the polarity of the image signal VD to − regardless of the shift direction of the projection pixel Pi upon transition from the fourth unit period sf4−1 of the frame period N to the first unit period sf1−2 of the frame period N+1.

Next, upon transition from the first unit period sf1−2 to the second unit period sf2−2, the light path shifting element 110 shifts the projection pixel Pi toward the one side X1 in the first direction X by 0.5 pixel pitch along the direction parallel to the first direction X.

At this time, the control unit 50 reverses the polarity of the image signal VD for all of the plurality of panel pixels Px from − to +.

Next, upon transition from the second unit period sf2−2 to the third unit period sf3−2, the light path shifting element 110 shifts the projection pixel Pi toward the one side Y1 in the second direction Y by 0.5 pixel pitch along the direction parallel to the second direction Y. At this time, the control unit 50 reverses the polarity of the image signal VD for all of the plurality of panel pixels Px from + to −.

Next, upon transition from the second unit period sf2−2 to the third unit period sf3−2, the light path shifting element 110 shifts the projection pixel Pi toward the one side Y1 in the second direction Y by 0.5 pixel pitch along the direction parallel to the second direction Y. At this time, the control unit 50 reverses the polarity of the image signal VD for all of the plurality of panel pixels Px from − to +. In this manner, the frame period N+1 is terminated.

Next, upon transition from the fourth unit period sf4−2 of the frame period N+1 to the first unit period sf1−1 of the frame period N, the light path shifting element 110 shifts the projection pixel Pi toward the other side Y2 in the second direction Y by 0.5 pixel pitch along the direction parallel to the second direction Y. In transition from the frame period N+1 to the frame period N in this manner, the control unit 50 reverses the polarity of the image signal VD supplied to the pixel electrode 41 of each of all of the plurality of panel pixels Px between the frame period N and the frame period N+1. In this embodiment, in the first unit period sf1−2 in the frame period N+1, the polarity of the image signal VD is −, and therefore the control unit 50 sets the polarity of the image signal VD to + regardless of the shift direction of the projection pixel Pi upon transition from the fourth unit period sf4−1 of the frame period N+1 to the first unit period sf1−1 of the frame period N. Thereafter, the frame period N and the frame period N+1 are alternately executed. As a result, in the projection image 100, the adjacent projection pixels Pi are driven with opposite polarities.

In this embodiment, the projection pixel Pi is shifted by the light path shifting element 110 in this manner, and thus the projection image 100 with a resolution higher than the panel resolution can be achieved. In addition, in the projection image 100, the adjacent projection pixels Pi are driven with opposite polarities, and thus the flicker or the like of the projection image 100 is less generated. Also in this case, all of the plurality of panel pixels Px are driven in the same polarity in a single unit period sf, and thus the load at the image processing unit 11 of the control unit 50 and the data line driving circuit 24 is small.

4. Second Exemplary Operation

Figure 9:
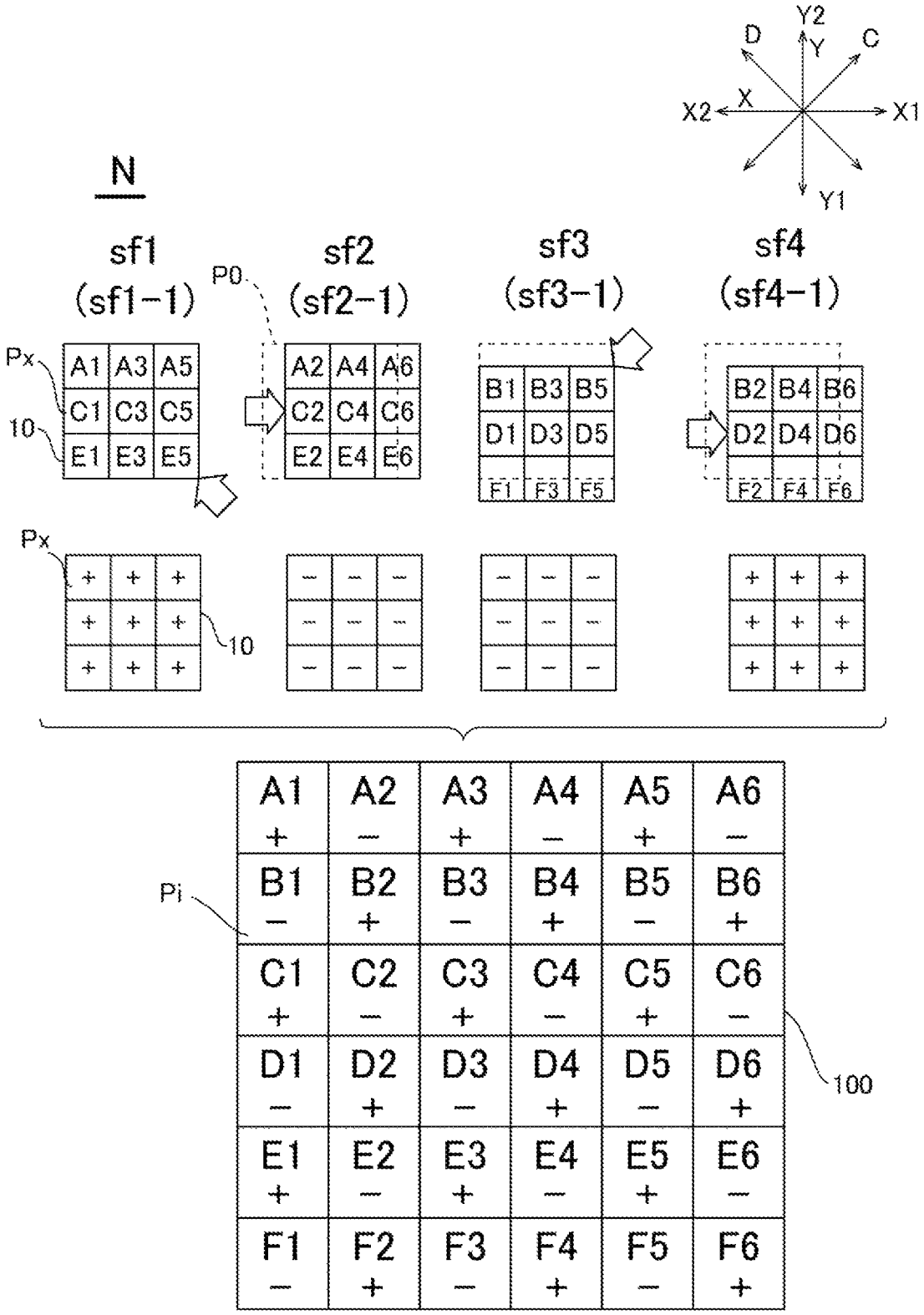
FIG. 9 is a diagram for describing a current frame period in a second exemplary operation of the projection-type display device illustrated in FIG. 1.
Figure 10:
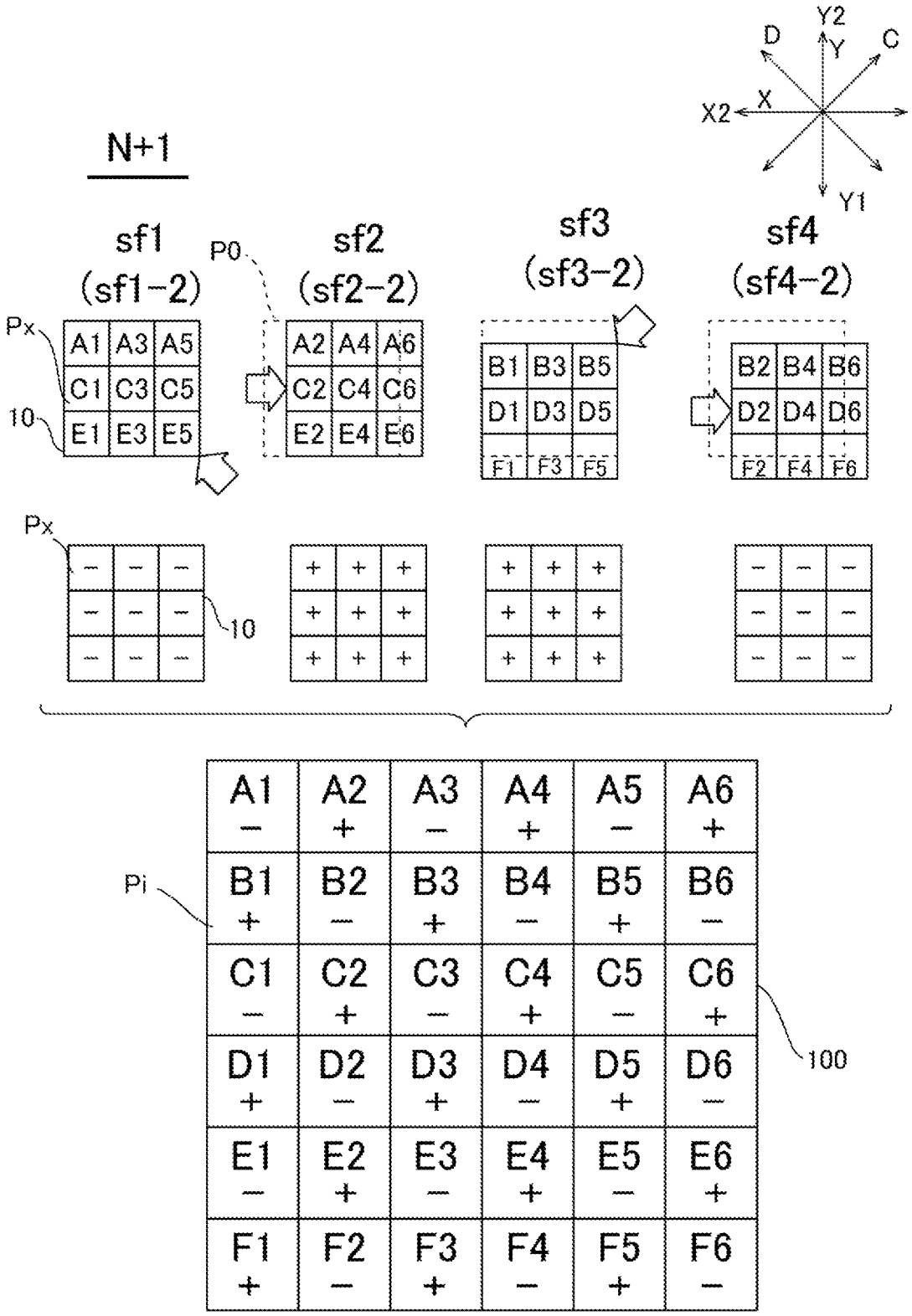
FIG. 10 is a diagram for describing a next frame period in the second exemplary operation of the projection-type display device illustrated in FIG. 1.

FIG. 9 is a diagram for describing a current frame period N in a second exemplary operation of the projection-type display device 1 illustrated in FIG. 1. FIG. 10 is a diagram for describing a next frame period N+1 in the second exemplary operation of the projection-type display device 1 illustrated in FIG. 1. In FIGS. 9 and 10, the upper section illustrates the shift direction of the light path shifting element 110, the projection pixel P expressed by the plurality of the panel pixels Px, and the polarities of the plurality of the panel pixels Px, and the lower section illustrates the polarities of the panel pixels Px when the plurality of the projection pixels Pi of the projection image 100 are expressed. Note that in the upper section of FIGS. 7 and 8, the dotted line indicates the positions of nine panel pixels Px of the first unit period sf1−1. The basic configuration of this example is the same as that of the first exemplary operation, and therefore the description for the common configurations, such as the description of the unit period sf and the like with reference to FIG. 6, will be omitted.

Also in this embodiment, as in the first exemplary operation, each of the current frame period N and the next frame period N+1 is divided into four unit periods sf, namely, the first unit period sf1, the second unit period sf2, the third unit period sf3, and the fourth unit period sf4, as illustrated in FIG. 6. In addition, in the frame period N, the four projection pixels A1, A2, B1 and B2 of the projection image 100 are expressed by the panel pixel a1. In addition, also in the frame period N+1, the four projection pixels A1, A2, B1 and B2 of the projection image 100 are expressed by the panel pixel a1.

Also in this embodiment, the light path shifting element 110 shifts the projection pixel Pi for each unit period sf in the frame period N illustrated in FIG. 9 and the frame period N+1 illustrated in FIG. 10. At this time, the control unit 50 sets the same polarity to the image signal VD supplied to the pixel electrode 41 of each of all of the plurality of panel pixels Px in the same unit period sf in the plurality of unit periods sf, and the control unit 50 reverses the polarity of the image signal VD supplied to the pixel electrode 41 of each of all of the plurality of panel pixels Px when the light path shifting element 110 shifts the projection pixel Pi along at least one of the direction parallel to the first direction X and the direction parallel to the second direction Y upon transition from the current unit period sf to the next unit period sf in the same frame period. In addition, the control unit 50 reverses the polarity of the image signal VD supplied to the pixel electrode 41 of each of all of the plurality of panel pixels Px between the current frame period N and the next frame period N+1.

In this embodiment, a plurality of shift directions of the light path shifting element 110 include, in addition to the first direction X, the third direction C that intersects both of the first direction X and the second direction Y, and the fourth direction D that obliquely intersects the first direction X and the second direction Y on the side opposite to the third direction C. Here, the control unit 50 reverses the polarity of the image signal VD supplied to the pixel electrode 41 of each of the plurality of the panel pixels Px when the light path shifting element 110 shifts the projection pixel Pi along the direction parallel to the first direction X in the same frame period N, whereas the control unit 50 does not reverse the polarity of the image signal VD supplied to the pixel electrode 41 of each of all of the plurality of panel pixels Px when the light path shifting element 110 shifts the projection pixel Pi along at least one of the direction parallel to the third direction C and the direction parallel to the fourth direction D.

More specifically, in the first unit period sf1−1 in the frame period N illustrated in FIG. 9, the control unit 50 sets the polarity of the image signal VD for all of the plurality of panel pixels Px to +.

Next, upon transition from the first unit period sf1−1 to the second unit period sf2−1, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from + to −.

Next, upon transition from the second unit period sf2−1 to the third unit period sf3−1, the light path shifting element 110 shifts the projection pixel Pi toward the other side X2 in the first direction X and the one side Y1 in the second direction Y by 0.5 pixel pitch along the direction parallel to the third direction C. At this time, the control unit 50 does not reverse the polarity of the image signal VD for all of the plurality of panel pixels Px, and therefore the polarity of the image signal VD is −.

Next, upon transition from the third unit period sf3−1 to the fourth unit period sf4−1, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from − to +. In this manner, the frame period N is terminated.

Next, as illustrated in FIG. 10, upon transition from the fourth unit period sf4−1 of the current frame period N to the first unit period sf1−2 of the next frame period N+1, the light path shifting element 110 shifts the projection pixel toward the other side X2 in the first direction X and the other side Y2 in the second direction Y Pi by 0.5 pixel pitch along the direction parallel to the fourth direction D. In transition from the current frame period N to the next frame period N+1 in this manner, the control unit 50 reverses the polarity of the image signal VD supplied to the pixel electrode 41 of all of the plurality of panel pixels Px between the current frame period N and the next frame period N+1. In this embodiment, the polarity of the image signal VD is + in the first unit period sf1−1 of the frame period N, and therefore, upon transition from the fourth unit period sf4−1 of the frame period N to the first unit period sf1−2 of the next frame period N+1, the control unit 50 sets the polarity of the image signal VD for all of the plurality of panel pixels Px to − regardless of the direction in which the projection image is shifted by the light path shifting element 110.

Next, upon transition from the first unit period sf1−2 to the second unit period sf2−2, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from − to +.

Next, upon transition from the second unit period sf2−1 to the third unit period sf3−1, the light path shifting element 110 shifts the projection pixel Pi toward the other side X2 in the first direction X and the one side Y1 in the second direction Y by 0.5 pixel pitch along the direction parallel to the third direction C. At this time, the control unit 50 does not reverse the polarity of the image signal VD, and therefore the polarity of the image signal VD for all of the plurality of panel pixels Px is +.

Next, upon transition from the third unit period sf3−1 to the fourth unit period sf4−1, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from + to −. In this manner, the frame period N+1 is terminated.

Next, upon transition from the fourth unit period sf4−2 of the frame period N+1 to the first unit period sf1−1 of the frame period N, the light path shifting element 110 shifts the projection pixel toward the other side X2 in the first direction X and the other side Y2 in the second direction Y Pi by 0.5 pixel pitch along the direction parallel to the fourth direction D. In this manner, upon transition from the next frame period N+1 to the frame period N, the control unit 50 reverses the polarity of the image signal VD supplied to the pixel electrode 41 of each of the plurality of the panel pixels Px between the frame period N+1 and the frame period N. In this embodiment, in the first unit period sf1−2 of the frame period N+1, the polarity of the image signal VD is −, and therefore, upon transition from the fourth unit period sf4−1 of the frame period N+1 to the first unit period sf1−1 of the frame period N, the control unit 50 sets the polarity of the image signal VD for all of the plurality of panel pixels Px to + regardless of the shift direction of the projection pixel Pi. Thereafter, the frame period N and the frame period N+1 are alternately executed. As a result, in the projection image 100, the adjacent projection pixels Pi are driven with opposite polarities.

In this embodiment, the projection pixel Pi is shifted by the light path shifting element 110 in this manner, and thus the projection image 100 with a resolution higher than the panel resolution can be achieved. In addition, in the projection image 100, the adjacent projection pixels Pi are driven with opposite polarities, and thus the flicker or the like of the projection image 100 is less generated. Also in this case, all of the plurality of panel pixels Px are driven in the same polarity in a single unit period sf, and thus the load at the image processing unit 11 of the control unit 50 and the data line driving circuit 24 is small.

5. Third Exemplary Operation

Figure 11:
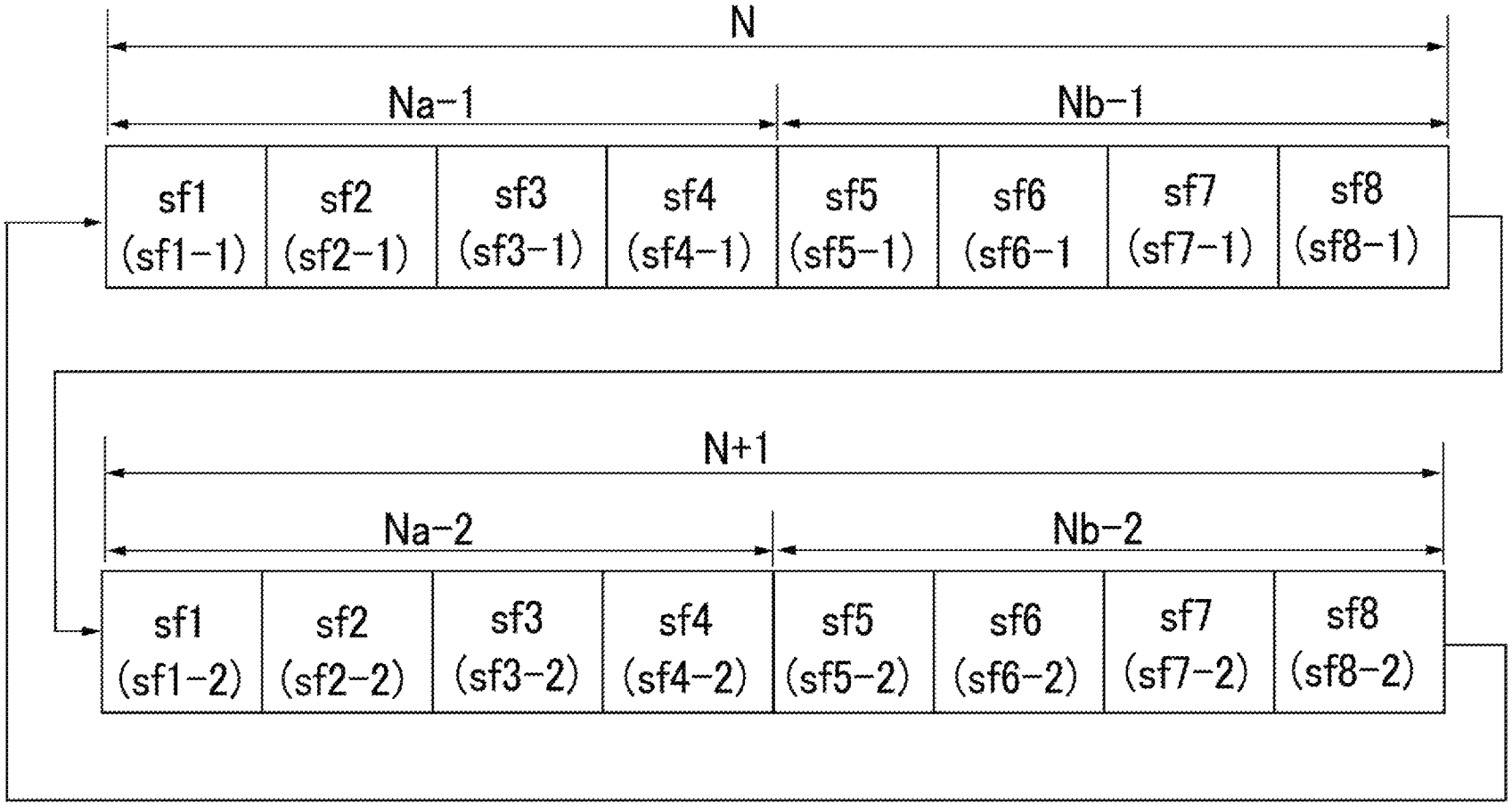
FIG. 11 is a diagram for describing a unit period in a third exemplary operation of the projection-type display device illustrated in FIG. 1.
Figure 12:
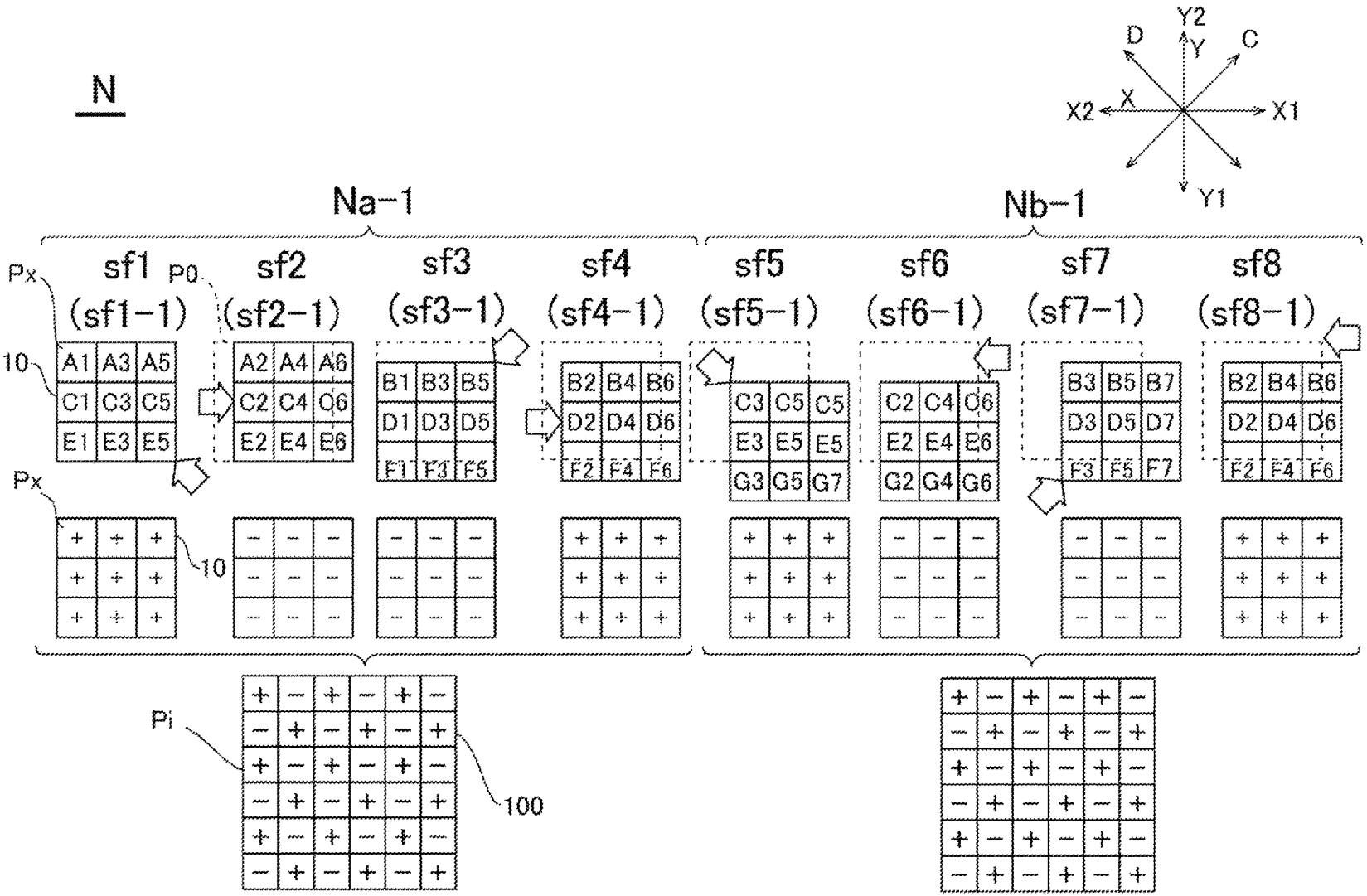
FIG. 12 is a diagram for describing a current frame period in the third exemplary operation of the projection-type display device illustrated in FIG. 1.
Figure 13:
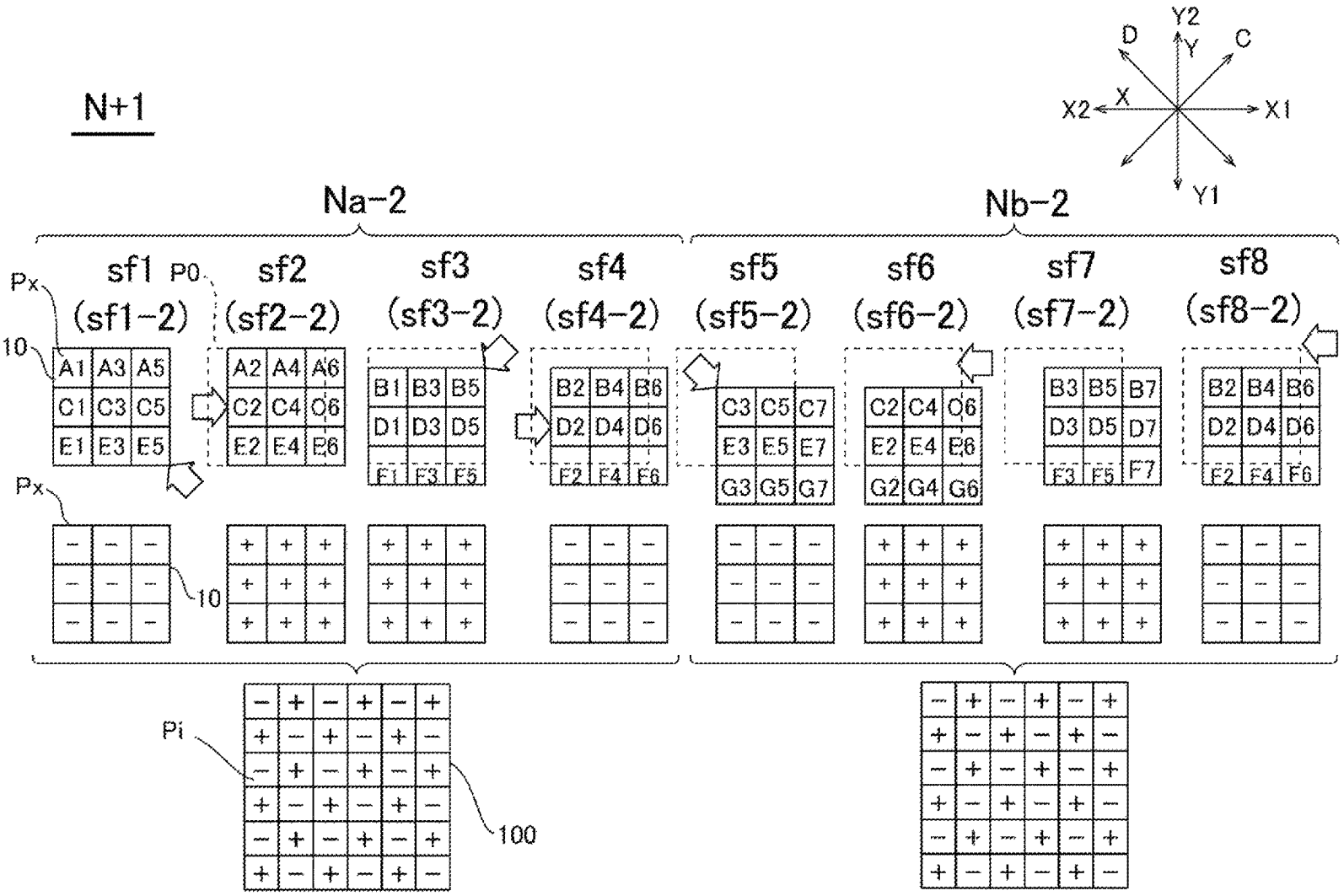
FIG. 13 is a diagram for describing a next frame period in the third exemplary operation of the projection-type display device illustrated in FIG. 1.
Figure 14:
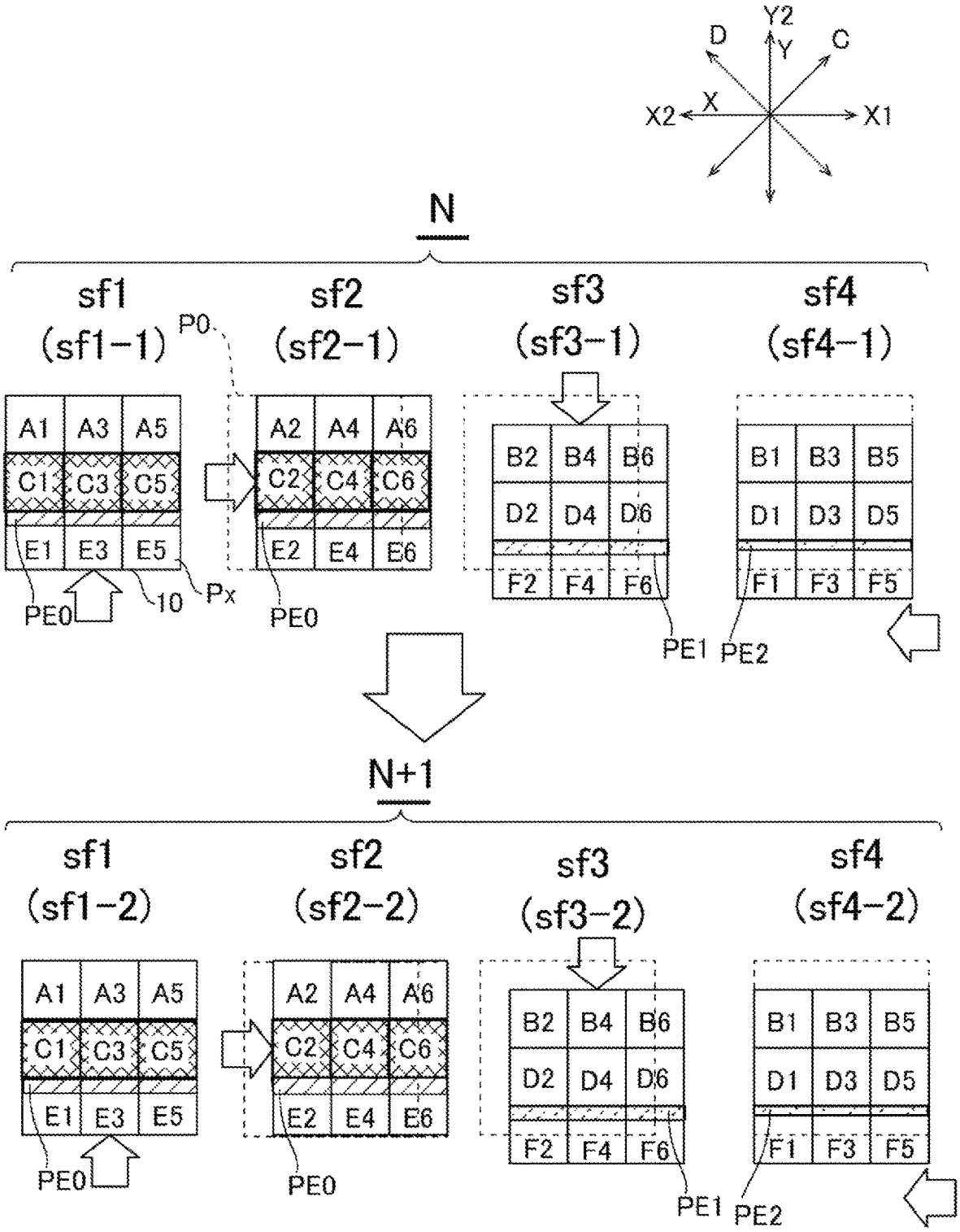
FIG. 14 is a diagram for describing an influence of the transverse electric field in the first exemplary operation.
Figure 15:
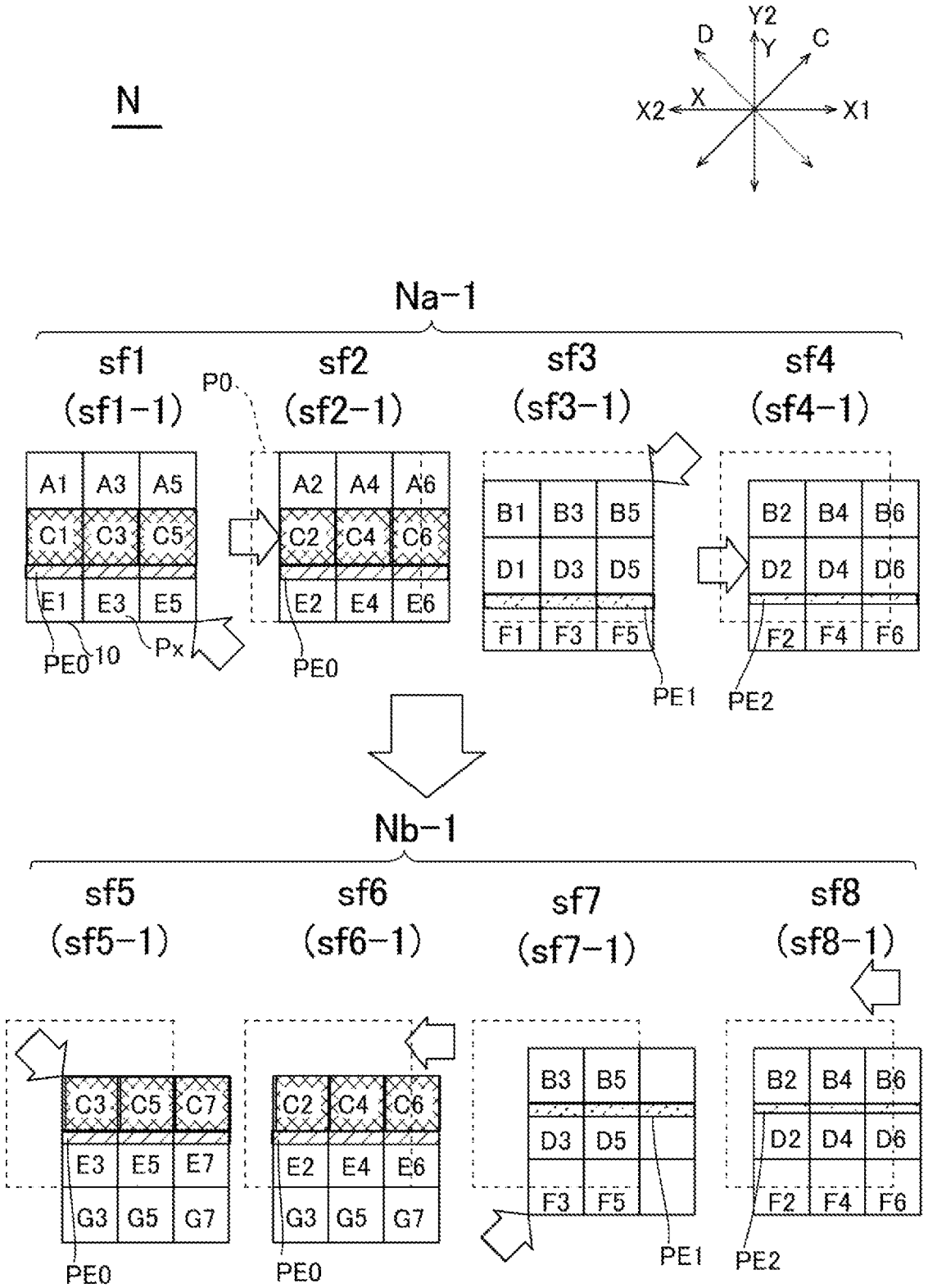
FIG. 15 is a diagram for describing an effect for transverse electric field in the third exemplary operation.

FIG. 11 is a diagram for describing a unit period in a third exemplary operation of the projection-type display device 1 illustrated in FIG. 1. FIG. 12 is a diagram for describing a current frame period N in the third exemplary operation of the projection-type display device 1 illustrated in FIG. 1. FIG. 13 is a diagram for describing a next frame period N+1 in the third exemplary operation of the projection-type display device 1 illustrated in FIG. 1. FIG. 14 is a diagram for describing an influence of the transverse electric field in the first exemplary operation. FIG. 15 is a diagram for describing an effect for the transverse electric field in the third exemplary operation. In FIGS. 11 and 12, the upper section illustrates the shift direction of the light path shifting element 110, the projection pixel P expressed by the plurality of the panel pixels Px, and the polarities of the plurality of the panel pixels Px, and the lower section illustrates the polarities of the panel pixels Px when the plurality of the projection pixels Pi of the projection image 100 are expressed. Note that in the upper section of FIGS. 12 and 13, the dotted line indicates the positions of nine panel pixels Px of the first unit period sf1−1. The basic configuration of this example is the same as that of the first exemplary operation, and therefore the description for the common configurations will be omitted.

As illustrated in FIG. 11, in this embodiment, each of the current frame period N and the next frame period N+1 is divided into eight unit periods sf, namely, the first unit period sf1, the second unit period sf2, the third unit period sf3, the fourth unit period sf4, a fifth unit period sf5, a sixth unit period sf6, a seventh unit period sf7, and an eighth unit period sf8. In FIGS. 11, 12, and 13, the eight unit periods sf in the frame period N and the eight unit periods sf in the frame period N+1 are discriminated as follows for the sake of convenience. In addition, each of the frame periods N and N+1 includes the first subframe period Na and the second subframe period Nb. Here, "−1" is attached to the first subframe period Na and the second subframe period Nb of the frame period N for the sake of convenience, and "−2" is attached to the first subframe period Na and the second subframe period Nb of the frame period N+1 for the sake of convenience.

Current frame period N
First subframe period Na−1
First unit period sf1−1
Second unit period sf2−1
Third unit period sf3−1
Fourth unit period sf4−1
Second subframe period Nb−1
Fifth unit period sf5−1
Sixth unit period sf6−1
Seventh unit period sf7−1
Eighth unit period sf8−1
Next frame period N+1
First subframe period Na−2
First unit period sf1−2
Second unit period sf2−2
Third unit period sf3−2
Second subframe period Nb−2
Fourth unit period sf4−2
Fifth unit period sf5−2
Sixth unit period sf6−2
Seventh unit period sf7−2
Eighth unit period sf8−2

In this embodiment, as illustrated in FIGS. 12 and 13, one frame of an image is displayed in each period of the first subframe period Na and the second subframe period Nb. Here, one projection pixel Pi is shifted to n (n is an integer of 2 or greater) locations in n unit periods sf in each of the first subframe period Na and the second subframe period Nb, and the region where the projection pixel Pi is shifted by the light path shifting element 110 is different between the first subframe period Na and the second subframe period Nb. In this embodiment, n is 4, and one projection pixel Pi is shifted to four locations in the four unit periods sf in each of the first subframe period Na and the second subframe period Nb.

More specifically, in the first subframe period Na in the frame period N and the next frame period N+1, the panel pixel a1 of the liquid crystal panel 10 expresses the four projection pixels A1, A2, B1 and B2. On the other hand, in the second subframe period Nb in the frame period N and the next frame period N+1, the panel pixel a1 of the liquid crystal panel 10 expresses four projection pixels B2, B3, C2 and C3. As such, in the first subframe period Na and the second subframe period Nb, the projection pixel B2 is in common, but the other projection pixels Pi are different. That is, the region where the projection pixel Pi is shifted by the light path shifting element 110 is different between the first subframe period Na and the second subframe period Nb.

The same applies to other panel pixels Px. For example, in the first subframe period Na in the frame period N and the next frame period N+1, the panel pixel a2 of the liquid crystal panel 10 expresses four projection pixels A3, A4, B3 and B4. On the other hand, in the second subframe period Nb in the frame period N and the next frame period N+1, the panel pixel a2 of the liquid crystal panel 10 expresses four projection pixels B4, B5, C4 and C5. As such, in the first subframe period Na and the second subframe period Nb, the projection pixel B4 is in common, but the other projection pixels Pi are different.

In addition, in the first subframe period Na in the frame period N and the next frame period N+1, the panel pixel b1 of the liquid crystal panel 10 expresses four projection pixels C1, C2, D1 and D2. On the other hand, in the second subframe period Nb in the frame period N and the next frame period N+1, the panel pixel b1 of the liquid crystal panel 10 expresses four projection pixels D2, D3, E2 and E3. As such, in the first subframe period Na and the second subframe period Nb, the projection pixel D2 is in common, but the other projection pixels Pi are different.

In this embodiment, in the frame period N and the frame period N+1, the light path shifting element 110 shifts the projection pixel Pi by 0.5 pixel pitch for each unit period sf. At this time, the control unit 50 sets the same polarity to the image signal VD supplied to the pixel electrode 41 of each of the plurality of the panel pixels Px in the same unit period sf in the plurality of unit periods sf, whereas the control unit 50 reverses the polarity of the image signal VD supplied to the pixel electrode 41 of each of the plurality of the panel pixels Px when the light path shifting element 110 shifts the projection image along at least one of the direction parallel to the first direction X and the direction parallel to the second direction Y upon transition from the current unit period sf to the next unit period sf in the same frame period N. In addition, the control unit 50 reverses the polarity of the image signal VD supplied to the pixel electrode 41 of each of the plurality of the panel pixels Px between the current frame period N and the next frame period N+1.

In this embodiment, as in the second exemplary operation, a plurality of shift directions of the light path shifting element 110 include, in addition to the first direction X, the third direction C that intersects both of the first direction X and the second direction Y, and the fourth direction D that obliquely intersects the first direction X and the second direction Y on the side opposite to the third direction C. Here, when the light path shifting element 110 shifts the projection image along the direction parallel to the first direction X in the same frame period N, the control unit 50 reverses the polarity of the image signal VD supplied to the pixel electrode 41 of each of the plurality of the panel pixels Px, whereas the control unit 50 does not reverse the polarity of the image signal VD supplied to the pixel electrode 41 of each of the plurality of the panel pixels Px when the light path shifting element 110 shifts the projection image along at least one of the direction parallel to the third direction C and the direction parallel to the fourth direction D.

More specifically, in the first subframe period Na−1 of the frame period N illustrated in FIG. 12, the control unit 50 sets the polarity of the image signal VD to + in the first unit period sf1−1.

Next, upon transition from the first unit period sf1−1 to the second unit period sf2−1 in the first subframe period Na−1, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from + to −.

Next, upon transition from the second unit period sf2−1 to the third unit period sf3−1 in the first subframe period Na−1, the light path shifting element 110 shifts the projection pixel Pi toward the other side X2 in the first direction X and the one side Y1 in the second direction Y by 0.5 pixel pitch along the direction parallel to the third direction C. At this time, the control unit 50 does not reverse the polarity of the image signal VD, and therefore the polarity of the image signal VD for all of the plurality of panel pixels Px is −.

Next, upon transition from the third unit period sf3−1 to the fourth unit period sf4−1 in the first subframe period Na−1, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from − to +.

Next, upon transition from the fourth unit period sf4−1 of the first subframe period Na−1 to the fifth unit period sf5−1 of the second subframe period Nb−1 in the frame period N, the light path shifting element 110 shifts the projection pixel Pi toward one side X1 in the first direction X and the one side Y1 in the second direction Y by 0.5 pixel pitch along the direction parallel to the fourth direction D. At this time, the control unit 50 does not reverse the polarity of the image signal VD, and therefore the polarity of the image signal VD for all of the plurality of panel pixels Px is +.

Next, upon transition from the fifth unit period sf5−1 to the sixth unit period sf6−1 in the second subframe period Nb−1, the light path shifting element 110 shifts the projection pixel Pi toward the other side X2 in the first direction X by 0.5 pixel pitch along the direction parallel to the first direction X. At this time, the control unit 50 reverses the polarity of the image signal VD for all of the plurality of panel pixels Px from + to −.

Next, upon transition from the sixth unit period sf6−1 to the seventh unit period sf7−1 in the second subframe period Nb−1, the light path shifting element 110 shifts the projection pixel Pi toward one side X1 in the first direction X and the one side Y1 in the second direction Y by 0.5 pixel pitch along the direction parallel to the third direction C. At this time, the control unit 50 does not reverse the polarity of the image signal VD, and therefore the polarity of the image signal VD for all of the plurality of panel pixels Px is −.

Next, upon transition from the seventh unit period sf7−1 to the eighth unit period sf8−1 in the second subframe period Nb−1, the light path shifting element 110 shifts the projection pixel Pi toward the other side X2 in the first direction X by 0.5 pixel pitch along the direction parallel to the first direction X. At this time, the control unit 50 reverses the polarity of the image signal VD for all of the plurality of panel pixels Px from − to +. In this manner, the frame period N is terminated.

Next, as illustrated in FIG. 13, upon transition from the eighth unit period sf8−1 of the second subframe period Nb−1 of the current frame period N to the first unit period sf1−2 of the first subframe period Na−1 of the next frame period N+1, the light path shifting element 110 shifts the projection pixel toward the other side X2 in the first direction X and the other side Y2 in the second direction Y Pi by 0.5 pixel pitch along the direction parallel to the fourth direction D. In transition from the current frame period N to the next frame period N+1 in this manner, the control unit 50 reverses the polarity of the image signal VD supplied to the pixel electrode 41 of each of all of the plurality of panel pixels Px between the current frame period N and the next frame period N+1. In this embodiment, in the first unit period sf1−1 in the frame period N illustrated in FIG. 12, the polarity of the image signal VD is +, and therefore the control unit 50 sets the polarity of the image signal VD for all of the plurality of panel pixels Px to − regardless of the shift direction of the projection pixel Pi upon transition from the eighth unit period sf8−1 of the current frame period N to the first unit period sf1−2 of the first subframe period Na−2 of the next frame period N+1.

Next, upon transition from the first unit period sf1−2 to the second unit period sf2−2 in the first subframe period Na−2, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from − to +.

Next, upon transition from the second unit period sf2−2 to the third unit period sf3−2 in the first subframe period Na−2, the light path shifting element 110 shifts the projection pixel Pi toward the other side X2 in the first direction X and the one side Y1 in the second direction Y by 0.5 pixel pitch along the direction parallel to the third direction C. At this time, the control unit 50 does not reverse the polarity of the image signal VD, and therefore the polarity of the image signal VD for all of the plurality of panel pixels Px is +.

Next, upon transition from the third unit period sf3−2 to the fourth unit period sf4−2 in the first subframe period Na−2, the light path shifting element 110 shifts the projection pixel Pi toward the one side X1 in the first direction X by 0.5 pixel pitch along the direction parallel to the first direction X. At this time, the control unit 50 reverses the polarity of the image signal VD for all of the plurality of panel pixels Px from + to −.

Next, upon transition from the fourth unit period sf4−2 of the first subframe period Na−2 to the fifth unit period sf5−2 of the second subframe period Nb−2 in the frame period N+1, the light path shifting element 110 shifts the projection pixel Pi toward one side X1 in the first direction X and the one side Y1 in the second direction Y by 0.5 pixel pitch along the direction parallel to the fourth direction D. At this time, the control unit 50 does not reverse the polarity of the image signal VD, and therefore the polarity of the image signal VD for all of the plurality of panel pixels Px is −.

Next, upon transition from the fifth unit period sf5−2 to the sixth unit period sf6−2 in the second subframe period Nb−2, the light path shifting element 110 shifts the projection pixel Pi toward the other side X2 in the first direction X by 0.5 pixel pitch along the direction parallel to the first direction X. At this time, the control unit 50 reverses the polarity of the image signal VD for all of the plurality of panel pixels Px from − to +.

Next, upon transition from the sixth unit period sf6−2 to the seventh unit period sf7−2 in the second subframe period Nb−2, the light path shifting element 110 shifts the projection pixel Pi toward one side X1 in the first direction X and the one side Y1 in the second direction Y by 0.5 pixel pitch along the direction parallel to the third direction C. At this time, the control unit 50 does not reverse the polarity of the image signal VD, and therefore the polarity of the image signal VD for all of the plurality of panel pixels Px is +.

Next, upon transition from the seventh unit period sf7−2 to the eighth unit period sf8−2 in the second subframe period Nb−2, the light path shifting element 110 shifts the projection pixel Pi toward the other side X2 in the first direction X by 0.5 pixel pitch along the direction parallel to the first direction X. At this time, the control unit 50 reverses the polarity of the image signal VD for all of the plurality of panel pixels Px from + to −. In this manner, the frame period N+1 is terminated.

Next, upon transition from the eighth unit period sf8−2 of the second subframe period Nb−2 of the frame period N+1 to the first unit period sf1−1 of the first subframe period Na−1 of the frame period N, the light path shifting element 110 shifts the projection pixel toward the other side X2 in the first direction X and the other side Y2 in the second direction Y Pi by 0.5 pixel pitch along the direction parallel to the fourth direction D. In transition from the next frame period N+1 to the current frame period N in this manner, the control unit 50 reverses the polarity of the image signal VD supplied to the pixel electrode 41 of each of the plurality of the panel pixels Px between the current frame period N and the next frame period N+1. In this embodiment, in the first unit period sf1−2 in the frame period N+1 illustrated in FIG. 12, the polarity of the image signal VD is −, and therefore the control unit 50 sets the polarity of the image signal VD for all of the plurality of panel pixels Px to + regardless of the shift direction of the projection pixel Pi upon transition from the eighth unit period sf8−1 of the frame period N+1 to the first unit period sf1−1 of the frame period N. Thereafter, the frame period N and the frame period N+1 are alternately executed. As a result, in the projection image 100, the adjacent projection pixels Pi are driven with opposite polarities.

In this embodiment, the projection pixel Pi is shifted by the light path shifting element 110 in this manner, and thus the projection image 100 with a resolution higher than the panel resolution can be achieved. In addition, in the projection image 100, the adjacent projection pixels Pi are driven with opposite polarities, and thus the flicker or the like of the projection image 100 is less generated. Also in this case, all of the plurality of panel pixels Px are driven in the same polarity in a single unit period sf, and thus the load at the image processing unit 11 of the control unit 50 and the data line driving circuit 24 is small.

In addition, as described below with reference to FIGS. 14 and 15, according to this embodiment, alignment defects of the liquid crystals due to the transverse electric field between the adjacent panel pixels Px can be reduced, and thus the quality of the projection image 100 is high. More specifically, for example, in the case where the panel pixel Px of the white display and the panel pixel Px of the black display are adjacent to each other, alignment defects of liquid crystal molecules easily occur under the influence of the transverse electric field at the boundary portion. In view of this, in the case where a black line extending in the first direction X is displayed at the third row with the white background in FIG. 5, the panel pixels b1, b2, . . . , are set to the black display at the timing of displaying the projection pixels C1, C2, . . . , with the other panel pixels Px set to the white display. In this case, alignment defects due to the transverse electric field occur between the panel pixels b1, b2, . . . , and the panel pixels c1, c2, . . . .

As a result, in the first exemplary operation illustrated in FIG. 14, a black shadow PE0 due to alignment defects appears between the projection pixels C1, C2, . . . of the third row and the projection pixels E1, E2, . . . of the fifth row in the first unit period sf−1 and the second unit period sf2−1 of the frame period N. In this state, the black shadow PE0 is not noticeable since the black shadow PE0 is contiguous with the projection pixels C1, C2, . . . of the black display. However, when the projection pixels C1, C2, . . . , of the black display are expressed in the third unit period sf3 of the frame period N, a residual portion PE1 of the black shadow is generated in the white background, and a residual portion PE2 of the black shadow slightly remains also in the fourth unit period sf4 of the frame period N. Here, in the case of the first exemplary operation, the same operation is repeated in the next frame period N+1. As such, in the first unit period sf1−2 and the second unit period sf2−2, the residual portion PE2 is contiguous with projection pixels C1, C2, . . . , of the black display and are therefore not noticeable; however, in the third unit period sf3−2 and the fourth unit period sf4−2, the residual portions PE1 and PE2 of the black shadow are generated at the same location as the frame period N even when the projection pixels C1, C2, . . . , of the black display are not expressed. Consequently, the residual portions PE1 and PE2 of the black shadow are likely to be noticeable.

Conversely, in the third exemplary operation illustrated in FIG. 15, in the first subframe period Na−1 and the second subframe period Nb−1 in the frame period N, the region where the light path shifting element 110 shifts one projection pixel Pi differs, and thus the residual portions PE1 and PE2 of the black shadow are less likely to be noticeable. More specifically, in the case where a black line extending in the first direction X is displayed at the third row with the white background in FIG. 5, the panel pixels b1, b2, . . . , are set to the black display at the timing of displaying the projection pixels C1, C2, . . . , with the other panel pixels Px set to the white display. In this case, alignment defects due to the transverse electric field occur between the panel pixels b1, b2, and the panel pixels c1, c2, As such, the black shadow PE0 due to alignment defects appears between the projection pixels C1, C2, of the third row and the projection pixels E1, E2, of the fifth row in the first unit period sf1−1 and the second unit period sf2−1 of the subframe period Na−1. In this state, the black shadow PE0 is not noticeable since the black shadow PE0 is contiguous with the projection pixels C1, C2, . . . of the black display. However, in the third unit period sf3−1 of the first subframe period Na−1, the projection pixels C1, C2, of the black display is not expressed, and therefore the residual portion PE1 of the black shadow is generated in the white background, and, also in the fourth unit period sf4 of the frame period N, the residual portion PE2 of the black shadow slightly remains. This situation is the same as in the third exemplary operation illustrated in FIG. 15.

It should be noted that in this embodiment, to express the projection pixels C1, C2, in the second subframe period Nb−1, the panel pixels a1, a2, are set to the black display, with the other panel pixels Px set to the white display. As a result, the black shadow PE0 due to alignment defects appears between the projection pixels C1, C2, . . . at the third row and the projection pixels E1, E2, at the fifth row in the first unit period sf1−1 and the second unit period sf2−1 of the second subframe period Nb−1, but the black shadow PE0 is not noticeable since the black shadow PE0 is contiguous with the projection pixels C1, C2, of the black display.

In addition, in the third unit period sf3−1 of the second subframe period Nb−1, the projection pixels C1, C2, of the black display are not expressed, and therefore the residual portion PE1 of the black shadow is generated in the white background, and, also in the fourth unit period sf4 of the frame period N, the residual portion PE2 of the black shadow slightly remains.

Even in this case, the location where alignment defect remains in the liquid crystal panel 10 is between the panel pixels a1, a2, and the panel pixels b1, b2, As such, the locations where the residual portions PE1 and PE2 of the black shadow appear differ between the first subframe period Na−1 and the second subframe period Nb−1, and thus the presence of the residual portions PE1 and PE2 of the black shadow is less likely to be noticeable.

What is claimed is:

1. A projection-type display device comprising:

a liquid crystal panel including a plurality of panel pixels;

a light path shifting element configured to generate a projection image by shifting, for each of a plurality of unit periods included in one frame period, a position of a projection pixel where light projected from one panel pixel of the plurality of panel pixels is visually recognized; and a control unit configured to control a timing when the light path shifting element shifts the projection pixel, a direction in which the light path shifting element shifts the projection pixel, and an image signal supplied to the plurality of panel pixels, wherein the control unit sets a polarity of the image signal to a same polarity in a same unit period among the plurality of unit periods, reverses the polarity of the image signal in each unit period of a current frame period upon transition from the current frame period to a next frame period, and reverses the polarity of the image signal when the light path shifting element shifts the projection pixel along at least one of a first direction and a second direction that intersects the first direction upon transition from a current unit period to a next unit period.

2. The projection-type display device according to claim 1, wherein when a direction that intersects both the first direction and the second direction is a third direction, and a direction that obliquely intersects the first direction and the second direction on a side opposite to the third direction is a fourth direction, the control unit does not reverse the polarity of the image signal when the light path shifting element shifts the projection pixel along at least one of a direction parallel to the third direction and a direction parallel to the fourth direction upon transition from the current unit period to the next unit period.

3. The projection-type display device according to claim 2, wherein the one frame period includes, as the plurality of unit periods, a first unit period, a second unit period, a third unit period, and a fourth unit period; and the light path shifting element shifts the projection pixel toward one side in the first direction along a direction parallel to the first direction upon transition from the first unit period to the second unit period, shifts the projection pixel toward the other side in the first direction and one side in the second direction along the third direction upon transition from the second unit period to the third unit period, shifts the projection pixel toward one side in the first direction along the direction parallel to the first direction upon transition from the third unit period to the fourth unit period, and shifts the projection pixel toward the other side in the first direction and the other side in the second direction along the fourth direction upon transition from the fourth unit period to the first unit period of the next frame period.

4. The projection-type display device according to claim 2, wherein the one frame period includes, as the plurality of unit periods, a first unit period, a second unit period, a third unit period, a fourth unit period, a fifth unit period, a sixth unit period, a seventh unit period, and an eighth unit period; and the light path shifting element shifts the projection pixel toward one side in the first direction along a direction parallel to the first direction upon transition from the first unit period to the second unit period, shifts the projection pixel toward the other side in the first direction and one side in the second direction along the third direction upon transition from the second unit period to the third unit period, shifts the projection pixel toward one side in the first direction along the direction parallel to the first direction upon transition from the third unit period to the fourth unit period, shifts the projection pixel toward one side in the first direction and one side in the second direction along the fourth direction upon transition from the fourth unit period to the fifth unit period, shifts the projection pixel toward the other side in the first direction along the direction parallel to the first direction upon transition from the fifth unit period to the sixth unit period, shifts the projection pixel toward one side in the first direction and the other side in the first direction along a direction parallel to the third direction upon transition from the sixth unit period to the seventh unit period, shifts the projection pixel toward the other side in the first direction along a direction parallel to the second direction upon transition from the seventh unit period to the eighth unit period, and shifts the projection pixel toward the other side in the first direction and the other side in the second direction along the fourth direction upon transition from the eighth unit period to the first unit period of the next frame period.

5. The projection-type display device according to claim 1, wherein the one frame period includes, as the plurality of unit periods, a first unit period, a second unit period, a third unit period, and a fourth unit period; and the light path shifting element shifts the projection pixel toward one side in the first direction along a direction parallel to the first direction upon transition from the first unit period to the second unit period, shifts the projection pixel toward one side in the second direction along a direction parallel to the second direction upon transition from the second unit period to the third unit period, shifts the projection pixel toward the other side in the first direction along the direction parallel to the first direction upon transition from the third unit period to the fourth unit period, and shifts the projection pixel toward the other side in the second direction along the direction parallel to the second direction upon transition from the fourth unit period to the first unit period of the next frame period.

6. The projection-type display device according to claim 1, wherein the frame period includes a first subframe period and a second subframe period subsequent to the first subframe period;

the light path shifting element shifts the projection pixel to n locations in n of the unit periods in each of the first subframe period and the second subframe period, n being an integer of 2 or greater; and a region where the light path shifting element shifts the projection pixel differs between the first subframe period and the second subframe period.

7. A control method for a projection-type display device, the projection-type display device including a liquid crystal panel including a plurality of panel pixels, the projection-type display device being configured to generate a projection image by shifting, for each of a plurality of unit periods included in one frame period, a position of a projection pixel where light projected from one panel pixel of the plurality of panel pixels is visually recognized, wherein a polarity of an image signal supplied to the plurality of panel pixels is set to a same polarity in a same unit period among the plurality of unit periods, the polarity of the image signal in each unit period of a current frame period is reversed upon transition from the current frame period to a next frame period, and the polarity of the image signal is reversed when the projection pixel is shifted along at least one of a first direction and a second direction that intersects the first direction upon transition from a current unit period to a next unit period.

8. The control method for a projection-type display device according to claim 7, wherein when a direction that intersects both the first direction and the second direction is a third direction, and a direction that obliquely intersects the first direction and the second direction on a side opposite to the third direction is a fourth direction, the polarity of the image signal is not reversed when the projection pixel is shifted along at least one of a direction parallel to the third direction and a direction parallel to the fourth direction upon transition from the current unit period to the next unit period.

9. The control method for a projection-type display device according to claim 8, wherein the one frame period includes, as the plurality of unit periods, a first unit period, a second unit period, a third unit period, and a fourth unit period; and the projection pixel is shifted toward one side in the first direction along a direction parallel to the first direction upon transition from the first unit period to the second unit period, the projection pixel is shifted toward the other side in the first direction and one side in the second direction along the third direction upon transition from the second unit period to the third unit period, the projection pixel is shifted toward one side in the first direction along the direction parallel to the first direction upon transition from the third unit period to the fourth unit period, and the projection pixel is shifted toward the other side in the first direction and the other side in the second direction along the fourth direction upon transition from the fourth unit period to the first unit period of the next frame period.

10. The control method for a projection-type display device according to claim 8, wherein the one frame period includes, as the plurality of unit periods, a first unit period, a second unit period, a third unit period, a fourth unit period, a fifth unit period, a sixth unit period, a seventh unit period, and an eighth unit period; and the projection pixel is shifted toward one side in the first direction along a direction parallel to the first direction upon transition from the first unit period to the second unit period, the projection pixel is shifted toward the other side in the first direction and one side in the second direction along the third direction upon transition from the second unit period to the third unit period, the projection pixel is shifted toward one side in the first direction along the direction parallel to the first direction upon transition from the third unit period to the fourth unit period, the projection pixel is shifted toward one side in the first direction and one side in the second direction along the fourth direction upon transition from the fourth unit period to the fifth unit period, the projection pixel is shifted toward the other side in the first direction along the direction parallel to the first direction upon transition from the fifth unit period to the sixth unit period, the projection pixel is shifted toward one side in the first direction and the other side in the first direction along a direction parallel to the third direction upon transition from the sixth unit period to the seventh unit period, the projection pixel is shifted toward the other side in the first direction along a direction parallel to the second direction upon transition from the seventh unit period to the eighth unit period, and the projection pixel is shifted toward the other side in the first direction and the other side in the second direction along the fourth direction upon transition from the eighth unit period to the first unit period of the next frame period.

11. The control method for a projection-type display device according to claim 7, wherein the one frame period includes, as the plurality of unit periods, a first unit period, a second unit period, a third unit period, and a fourth unit period; and the projection pixel is shifted toward one side in the first direction along a direction parallel to the first direction upon transition from the first unit period to the second unit period, the projection pixel is shifted toward one side in the second direction along a direction parallel to the second direction upon transition from the second unit period to the third unit period, the projection pixel is shifted toward the other side in the first direction along the direction parallel to the first direction upon transition from the third unit period to the fourth unit period, and the projection pixel is shifted toward the other side in the second direction along the direction parallel to the second direction upon transition from the fourth unit period to the first unit period of the next frame period.

12. The control method for a projection-type display device according to claim 7, wherein the frame period includes a first subframe period and a second subframe period subsequent to the first subframe period;

the projection pixel is shifted to n locations in n of the unit periods in each of the first subframe period and the second subframe period, n being an integer of 2 or greater; and a region where the projection pixel is shifted differs between the first subframe period and the second subframe period.

* * * * *